US007938290B2

(12) United States Patent
Bulso

(10) Patent No.: US 7,938,290 B2
(45) Date of Patent: May 10, 2011

(54) CONTAINER END CLOSURE HAVING IMPROVED CHUCK WALL WITH STRENGTHENING BEAD AND COUNTERSINK

(75) Inventor: Joseph D. Bulso, Canton, OH (US)

(73) Assignee: Ball Corporation, Broomfield, CO (US)

( * ) Notice: Subject to any disclaimer, the term of this patent is extended or adjusted under 35 U.S.C. 154(b) by 231 days.

(21) Appl. No.: 12/240,481

(22) Filed: Sep. 29, 2008

(65) Prior Publication Data

US 2009/0020543 A1 Jan. 22, 2009

Related U.S. Application Data

(62) Division of application No. 11/235,827, filed on Sep. 26, 2005, now abandoned.

(51) Int. Cl.
*B65D 6/30* (2006.01)
*B65D 8/04* (2006.01)

(52) U.S. Cl. ..... 220/623; 220/619; 220/258.2; 220/269; 220/906

(58) Field of Classification Search ..... 220/258.2, 220/269–273, 623, 906, 615–621
See application file for complete search history.

(56) References Cited

U.S. PATENT DOCUMENTS

| | | | |
|---|---|---|---|
| 91,754 | A | 6/1869 | Lawernce |
| 163,747 | A | 5/1875 | Cummings |
| 706,296 | A | 8/1902 | Bradley |
| 766,604 | A | 8/1904 | Dilg |
| 801,683 | A | 10/1905 | Penfold |
| 818,438 | A | 4/1906 | Heindorf |
| 868,916 | A | 10/1907 | Dieckmann |
| 1,045,055 | A | 11/1912 | Mittinger, Jr. |
| 2,060,145 | A | 11/1936 | Vogel |
| 2,318,603 | A | 5/1943 | Erb |
| D141,415 | S | 5/1945 | Wargel et al. |
| 2,759,628 | A | 8/1956 | Sokoloff |
| 2,894,844 | A | 7/1959 | Shakman |
| 3,023,927 | A | 3/1962 | Ehman |
| 3,025,814 | A | 3/1962 | Currie et al. |
| 3,105,765 | A | 10/1963 | Creegan |
| 3,176,872 | A | 4/1965 | Zundel |
| 3,208,627 | A | 9/1965 | Lipske |
| 3,251,515 | A | 5/1966 | Henchert et al. |

(Continued)

FOREIGN PATENT DOCUMENTS

| | | |
|---|---|---|
| CH | 327383 | 1/1958 |
| DE | 734942 | 5/1943 |
| DE | 9211788 | 1/1993 |
| EP | 0049020 | 4/1982 |
| EP | 0139282 | 5/1985 |
| EP | 0153115 | 8/1985 |

(Continued)

OTHER PUBLICATIONS

Author Unknown, "Brewing Industry Recommended Can Specifications Manual", United States Brewers Assoc., Inc, 1981 (with 1983 revisions), pp. 1-7.
Author Unknown, "Beverage Can, End, & Double Seam Dimensional Specifications", Society of Soft Drink Technologists, Aug. 1993, pp. 1-6.
Author Unknown, "Guideline Booklet of the Society of Soft Drink Technologists", Jun. 5, 1986, pp. 1-21.

*Primary Examiner* — Anthony Stashick
*Assistant Examiner* — Ned A Walker
(74) *Attorney, Agent, or Firm* — Sheridan Ross P.C.

(57) ABSTRACT

The present invention describes a beverage can end which utilizes less material and has an improved internal buckle strength based on the geometric configuration of a chuck wall, inner panel wall and central panel, and which, in one embodiment utilizes an arcuate shaped chuck wall with a radius of curvature between about 0.150 inches and 0.250 inches with at least one transition zone positioned between an upper and lower end of the chuck wall.

19 Claims, 16 Drawing Sheets

U.S. PATENT DOCUMENTS

| | | | | |
|---|---|---|---|---|
| 3,268,105 | A | | 8/1966 | Geiger |
| D206,500 | S | | 12/1966 | Nissen et al. |
| 3,383,748 | A | | 5/1968 | Galimberti et al. |
| 3,397,811 | A | | 8/1968 | Lipske |
| 3,417,898 | A | | 12/1968 | Bozek et al. |
| 3,480,175 | A | | 11/1969 | Khoury |
| 3,525,455 | A | | 8/1970 | Saunders |
| 3,564,895 | A | | 2/1971 | Pfanner et al. |
| 3,650,387 | A | | 3/1972 | Hornsby et al. |
| 3,715,054 | A | | 2/1973 | Gedde |
| 3,734,338 | A | | 5/1973 | Schubert |
| 3,744,667 | A | | 7/1973 | Fraze et al. |
| 3,745,623 | A | | 7/1973 | Wentorf, Jr. et al. |
| 3,757,716 | A | | 9/1973 | Gedde |
| 3,762,005 | A | | 10/1973 | Erkfritz |
| 3,765,352 | A | | 10/1973 | Schubert et al. |
| D229,396 | S | | 11/1973 | Zundel |
| 3,774,801 | A | | 11/1973 | Gedde |
| 3,814,279 | A | | 6/1974 | Rayzal |
| 3,836,038 | A | | 9/1974 | Cudzik |
| 3,843,014 | A | | 10/1974 | Cospen et al. |
| 3,868,919 | A | | 3/1975 | Schrecker et al. |
| 3,871,314 | A | | 3/1975 | Stargell |
| 3,874,553 | A | | 4/1975 | Schultz et al. |
| 3,904,069 | A | | 9/1975 | Toukmanian |
| 3,967,752 | A | | 7/1976 | Cudzik |
| 3,982,657 | A | | 9/1976 | Keller et al. |
| 3,983,827 | A | | 10/1976 | Meadors |
| 4,015,744 | A | | 4/1977 | Brown |
| 4,024,981 | A | | 5/1977 | Brown |
| 4,030,631 | A | | 6/1977 | Brown |
| 4,031,837 | A | * | 6/1977 | Jordan ..... 413/8 |
| 4,037,550 | A | | 7/1977 | Zofko |
| 4,043,168 | A | | 8/1977 | Mazurek |
| 4,056,871 | A | | 11/1977 | Bator |
| 4,087,193 | A | | 5/1978 | Mundy |
| 4,093,102 | A | | 6/1978 | Kraska |
| 4,109,599 | A | | 8/1978 | Schultz |
| 4,116,361 | A | | 9/1978 | Stargell |
| 4,126,652 | A | | 11/1978 | Oohara et al. |
| 4,127,212 | A | | 11/1978 | Waterbury |
| 4,148,410 | A | | 4/1979 | Brown |
| 4,150,765 | A | | 4/1979 | Mazurek |
| 4,210,257 | A | | 7/1980 | Radtke |
| 4,213,324 | A | | 7/1980 | Kelley et al. |
| 4,215,795 | A | | 8/1980 | Elser |
| 4,217,843 | A | | 8/1980 | Kraska |
| 4,271,778 | A | | 6/1981 | Le Bret |
| 4,274,351 | A | | 6/1981 | Boardman |
| 4,276,993 | A | | 7/1981 | Hasegawa |
| 4,286,728 | A | | 9/1981 | Fraze et al. |
| 4,341,321 | A | | 7/1982 | Gombas |
| 4,365,499 | A | | 12/1982 | Hirota et al. |
| 4,387,827 | A | | 6/1983 | Ruemer, Jr. |
| 4,402,419 | A | | 9/1983 | MacPherson |
| 4,420,283 | A | | 12/1983 | Post |
| 4,434,641 | A | | 3/1984 | Nguyen |
| 4,435,969 | A | | 3/1984 | Nichols et al. |
| 4,448,322 | A | | 5/1984 | Kraska |
| 4,467,933 | A | | 8/1984 | Wilkinson et al. |
| 4,516,420 | A | | 5/1985 | Bulso et al. |
| D279,265 | S | | 6/1985 | Turner et al. |
| 4,530,631 | A | | 7/1985 | Kaminski et al. |
| D281,581 | S | | 12/1985 | MacEwen |
| 4,559,801 | A | | 12/1985 | Smith et al. |
| 4,563,887 | A | | 1/1986 | Bressan et al. |
| 4,571,978 | A | | 2/1986 | Taube et al. |
| 4,577,774 | A | | 3/1986 | Nguyen |
| 4,578,007 | A | | 3/1986 | Diekhoff |
| 4,587,825 | A | | 5/1986 | Bulso et al. |
| 4,587,826 | A | | 5/1986 | Bulso et al. |
| 4,606,472 | A | | 8/1986 | Taube et al. |
| D285,661 | S | | 9/1986 | Brown Bill |
| 4,641,761 | A | | 2/1987 | Smith et al. |
| 4,674,649 | A | | 6/1987 | Pavely |
| 4,681,238 | A | | 7/1987 | Sanchez |
| 4,685,582 | A | | 8/1987 | Pulciani et al. |
| 4,685,849 | A | | 8/1987 | Labarge et al. |
| 4,697,972 | A | | 10/1987 | Le Bret et al. |
| 4,704,887 | A | | 11/1987 | Bachmann et al. |
| 4,713,958 | A | | 12/1987 | Bulso, Jr. et al. |
| 4,715,208 | A | | 12/1987 | Bulso, Jr. et al. |
| 4,716,755 | A | | 1/1988 | Bulso, Jr. et al. |
| 4,722,215 | A | | 2/1988 | Taube et al. |
| 4,735,863 | A | | 4/1988 | Bachmann et al. |
| 4,781,047 | A | | 11/1988 | Bressan et al. |
| 4,790,705 | A | | 12/1988 | Wilkinson et al. |
| 4,796,772 | A | | 1/1989 | Nguyen |
| 4,804,106 | A | | 2/1989 | Saunders |
| 4,808,052 | A | | 2/1989 | Bulso, Jr. et al. |
| 4,809,861 | A | | 3/1989 | Wilkinson |
| D300,607 | S | | 4/1989 | Ball |
| D300,608 | S | | 4/1989 | Taylor et al. |
| 4,820,100 | A | | 4/1989 | Riviere |
| 4,823,973 | A | | 4/1989 | Jewitt et al. |
| 4,832,223 | A | | 5/1989 | Kalenak et al. |
| 4,832,236 | A | | 5/1989 | Greaves |
| 4,865,506 | A | | 9/1989 | Kaminski |
| D304,302 | S | | 10/1989 | Dalli et al. |
| 4,885,924 | A | | 12/1989 | Claydon et al. |
| 4,890,759 | A | | 1/1990 | Scanga et al. |
| 4,893,725 | A | | 1/1990 | Ball et al. |
| 4,895,012 | A | | 1/1990 | Cook et al. |
| 4,919,294 | A | | 4/1990 | Kawamoto |
| RE33,217 | E | | 5/1990 | Nguyen |
| 4,930,658 | A | | 6/1990 | McEldowney |
| 4,934,168 | A | | 6/1990 | Osmanski et al. |
| 4,955,223 | A | | 9/1990 | Stodd et al. |
| 4,967,538 | A | | 11/1990 | Leftault, Jr. et al. |
| 4,991,735 | A | | 2/1991 | Biondich |
| 4,994,009 | A | | 2/1991 | McEldowney |
| 4,995,223 | A | | 2/1991 | Spatafora et al. |
| 5,016,463 | A | | 5/1991 | Johansson et al. |
| 5,026,960 | A | | 6/1991 | Slutz et al. |
| 5,027,580 | A | | 7/1991 | Hymes et al. |
| 5,042,284 | A | | 8/1991 | Stodd et al. |
| 5,046,637 | A | | 9/1991 | Kysh |
| 5,064,087 | A | | 11/1991 | Koch |
| 5,066,184 | A | | 11/1991 | Taura et al. |
| 5,069,355 | A | | 12/1991 | Matuszak |
| 5,105,977 | A | | 4/1992 | Taniuchi |
| 5,129,541 | A | | 7/1992 | Voigt et al. |
| 5,141,367 | A | | 8/1992 | Beeghly et al. |
| 5,143,504 | A | | 9/1992 | Braakman |
| 5,145,086 | A | | 9/1992 | Krause |
| 5,149,238 | A | | 9/1992 | McEldowney et al. |
| 5,174,706 | A | | 12/1992 | Taniuchi |
| 5,222,385 | A | | 6/1993 | Halasz et al. |
| D337,521 | S | | 7/1993 | McNulty |
| 5,245,848 | A | | 9/1993 | Lee, Jr. et al. |
| 5,289,938 | A | | 3/1994 | Sanchez |
| D347,172 | S | | 5/1994 | Heynan et al. |
| 5,309,749 | A | | 5/1994 | Stodd |
| 5,320,469 | A | | 6/1994 | Katou et al. |
| 5,325,696 | A | | 7/1994 | Jentzsch et al. |
| 5,355,709 | A | | 10/1994 | Bauder et al. |
| 5,356,256 | A | | 10/1994 | Turner et al. |
| D352,898 | S | | 11/1994 | Vacher |
| 5,381,683 | A | | 1/1995 | Cowling |
| D356,498 | S | | 3/1995 | Strawser |
| 5,465,599 | A | | 11/1995 | Lee, Jr. |
| 5,494,184 | A | | 2/1996 | Noguchi et al. |
| 5,497,184 | A | | 3/1996 | Noguchi et al. |
| 5,502,995 | A | | 4/1996 | Stodd |
| 5,524,468 | A | | 6/1996 | Jentzsch et al. |
| 5,527,143 | A | | 6/1996 | Turner et al. |
| 5,540,352 | A | | 7/1996 | Halasz et al. |
| 5,563,107 | A | | 10/1996 | Dubensky et al. |
| 5,582,319 | A | | 12/1996 | Heyes et al. |
| 5,590,807 | A | | 1/1997 | Forrest et al. |
| 5,598,734 | A | | 2/1997 | Forrest et al. |
| 5,612,264 | A | | 3/1997 | Nilsson et al. |
| 5,634,366 | A | | 6/1997 | Stodd |
| 5,636,761 | A | | 6/1997 | Diamond et al. |
| 5,653,355 | A | | 8/1997 | Tominaga et al. |
| 5,676,512 | A | | 10/1997 | Diamond et al. |
| 5,685,189 | A | | 11/1997 | Nguyen et al. |

| | | | | |
|---|---|---|---|---|
| 5,697,242 | A | 12/1997 | Halasz et al. | |
| 5,706,686 | A | 1/1998 | Babbitt et al. | |
| 5,749,488 | A | 5/1998 | Bagwell et al. | |
| 5,823,730 | A | 10/1998 | La Rovere | |
| 5,829,623 | A | 11/1998 | Otsuka et al. | |
| 5,857,374 | A | 1/1999 | Stodd | |
| D406,236 | S | 3/1999 | Brifcani et al. | |
| 5,911,551 | A | 6/1999 | Moran | |
| 5,934,127 | A | 8/1999 | Ihly | |
| 5,950,858 | A | 9/1999 | Sergeant | |
| 5,957,647 | A | 9/1999 | Hinton | |
| 5,969,605 | A | 10/1999 | McIntyre et al. | |
| 5,971,259 | A | 10/1999 | Bacon | |
| 6,024,239 | A | 2/2000 | Turner et al. | |
| 6,033,789 | A | 3/2000 | Saveker et al. | |
| 6,055,836 | A | 5/2000 | Waterworth et al. | |
| 6,058,753 | A | 5/2000 | Jowitt et al. | |
| 6,065,634 | A | 5/2000 | Brifcani et al. | |
| 6,089,072 | A | 7/2000 | Fields | |
| 6,102,243 | A | 8/2000 | Fields et al. | |
| 6,126,034 | A | 10/2000 | Borden et al. | |
| 6,131,761 | A | 10/2000 | Cheng et al. | |
| 6,234,337 | B1 | 5/2001 | Huber et al. | |
| 6,290,447 | B1 | 9/2001 | Siemonsen et al. | |
| 6,296,139 | B1 | 10/2001 | Hanafusa et al. | |
| D452,155 | S | 12/2001 | Stodd | |
| 6,386,013 | B1 | 5/2002 | Werth | |
| 6,408,498 | B1 | 6/2002 | Fields et al. | |
| 6,419,110 | B1 | 7/2002 | Stodd | |
| 6,425,493 | B1 | 7/2002 | Gardiner | |
| 6,425,721 | B1 | 7/2002 | Zysset | |
| 6,428,261 | B1 | 8/2002 | Zysset | |
| 6,460,723 | B2 | 10/2002 | Nguyen et al. | |
| 6,499,622 | B1 | 12/2002 | Neiner | |
| 6,516,968 | B2 | 2/2003 | Stodd | |
| 6,526,799 | B2 | 3/2003 | Ferraro et al. | |
| 6,561,004 | B1 | 5/2003 | Neiner et al. | |
| 6,616,393 | B1 | 9/2003 | Jentzsch | |
| D480,304 | S | 10/2003 | Stodd | |
| 6,634,837 | B1 | 10/2003 | Anderson | |
| 6,658,911 | B2 | 12/2003 | McClung | |
| 6,702,142 | B2 | 3/2004 | Neiner | |
| 6,702,538 | B1 | 3/2004 | Heinicke et al. | |
| 6,736,283 | B1 | 5/2004 | Santamaria et al. | |
| 6,748,789 | B2 | 6/2004 | Turner et al. | |
| 6,761,280 | B2 | 7/2004 | Zonker et al. | |
| 6,772,900 | B2 | 8/2004 | Turner et al. | |
| 6,837,089 | B2 | 1/2005 | Jentzsch et al. | |
| 6,848,875 | B2 | 2/2005 | Brifcani et al. | |
| 6,877,941 | B2 | 4/2005 | Brifcani et al. | |
| 6,915,553 | B2 | 7/2005 | Turner et al. | |
| 6,935,826 | B2 | 8/2005 | Brifcani et al. | |
| 6,959,577 | B2 | 11/2005 | Jentzsch | |
| 6,968,724 | B2 | 11/2005 | Hubball | |
| 7,004,345 | B2 | 2/2006 | Turner et al. | |
| 7,100,789 | B2 | 9/2006 | Nguyen et al. | |
| 7,125,214 | B2 | 10/2006 | Carrein et al. | |
| 7,174,762 | B2 | 2/2007 | Turner et al. | |
| 7,263,868 | B2 | 9/2007 | Jentzsch et al. | |
| 7,341,163 | B2 | 3/2008 | Stodd | |
| 7,350,392 | B2 | 4/2008 | Turner et al. | |
| 7,370,774 | B2 | 5/2008 | Watson et al. | |
| 7,380,684 | B2 | 6/2008 | Reed et al. | |
| 7,500,376 | B2 | 3/2009 | Bathurst et al. | |
| 7,506,779 | B2 | 3/2009 | Jentzsch et al. | |
| 7,591,392 | B2 * | 9/2009 | Watson et al. | 220/619 |
| 7,673,768 | B2 * | 3/2010 | Reed et al. | 220/619 |
| 7,819,275 | B2 * | 10/2010 | Stodd et al. | 220/619 |
| 2001/0037668 | A1 | 11/2001 | Fields | |
| 2002/0134788 | A1 * | 9/2002 | Nguyen et al. | 220/624 |
| 2002/0139805 | A1 | 10/2002 | Chasteen et al. | |
| 2002/0158071 | A1 | 10/2002 | Chasteen et al. | |
| 2002/0190071 | A1 * | 12/2002 | Neiner | 220/619 |
| 2003/0010785 | A1 * | 1/2003 | Stodd | 220/623 |
| 2003/0042258 | A1 * | 3/2003 | Turner et al. | 220/269 |
| 2003/0121924 | A1 * | 7/2003 | Stodd | 220/608 |
| 2003/0173367 | A1 * | 9/2003 | Nguyen et al. | 220/669 |
| 2003/0177803 | A1 | 9/2003 | Golding et al. | |
| 2003/0198538 | A1 | 10/2003 | Brifcani et al. | |
| 2004/0026433 | A1 | 2/2004 | Brifcani et al. | |
| 2004/0026434 | A1 | 2/2004 | Brifcani et al. | |
| 2004/0052593 | A1 | 3/2004 | Anderson | |
| 2004/0065663 | A1 * | 4/2004 | Turner et al. | 220/254.1 |
| 2004/0074911 | A1 * | 4/2004 | Stodd | 220/619 |
| 2004/0094559 | A1 * | 5/2004 | Santamaria et al. | 220/608 |
| 2004/0140312 | A1 | 7/2004 | Neiner | |
| 2004/0211780 | A1 * | 10/2004 | Turner et al. | 220/270 |
| 2004/0238546 | A1 | 12/2004 | Watson et al. | |
| 2005/0029269 | A1 | 2/2005 | Stodd | |
| 2005/0115976 | A1 | 6/2005 | Watson et al. | |
| 2005/0247717 | A1 | 11/2005 | Brifcani et al. | |
| 2005/0252922 | A1 | 11/2005 | Reed et al. | |
| 2006/0010957 | A1 | 1/2006 | Hubball | |
| 2006/0071005 | A1 | 4/2006 | Bulso | |
| 2010/0243663 | A1 | 9/2010 | Jentzsch et al. | |

FOREIGN PATENT DOCUMENTS

| | | |
|---|---|---|
| EP | 0340955 | 11/1989 |
| EP | 0348070 | 12/1989 |
| EP | 0482581 | 4/1992 |
| EP | 0828663 | 12/1999 |
| EP | 1361164 | 11/2003 |
| FR | 917771 | 1/1947 |
| GB | 767029 | 1/1957 |
| GB | 2196891 | 5/1988 |
| GB | 2218024 | 11/1989 |
| GB | 2315478 | 2/1998 |
| JP | 49-096887 | 9/1974 |
| JP | 50-144580 | 11/1975 |
| JP | 54-074184 | 6/1979 |
| JP | 55-122945 | 9/1980 |
| JP | 56-032227 | 4/1981 |
| JP | 56-53835 | 5/1981 |
| JP | 56-53836 | 5/1981 |
| JP | 56-107323 | 8/1981 |
| JP | 57-44435 | 3/1982 |
| JP | 57-94436 | 6/1982 |
| JP | S57-117323 | 7/1982 |
| JP | 58-035028 | 3/1983 |
| JP | 58-35029 | 3/1983 |
| JP | 59-144535 | 8/1984 |
| JP | 61-023533 | 2/1986 |
| JP | 63-125152 | 5/1988 |
| JP | 1-167050 | 6/1989 |
| JP | 1-170538 | 7/1989 |
| JP | 1-289526 | 11/1989 |
| JP | 2-092426 | 4/1990 |
| JP | 2-131931 | 5/1990 |
| JP | 2-192837 | 7/1990 |
| JP | 3-032835 | 2/1991 |
| JP | 3-275443 | 12/1991 |
| JP | 4-033733 | 2/1992 |
| JP | 4-055028 | 2/1992 |
| JP | 5-032255 | 2/1993 |
| JP | 5-112357 | 5/1993 |
| JP | H5-112357 | 5/1993 |
| JP | 5-185170 | 7/1993 |
| JP | 6-127547 | 5/1994 |
| JP | 6-179445 | 6/1994 |
| JP | 7-171645 | 7/1995 |
| JP | 8-168837 | 7/1996 |
| JP | 8-192840 | 7/1996 |
| JP | 2000-109068 | 4/2000 |
| WO | WO 83/02577 | 8/1983 |
| WO | WO 89/10216 | 11/1989 |
| WO | WO 93/17864 | 9/1993 |
| WO | WO 96/37414 | 11/1996 |
| WO | WO 98/34743 | 8/1998 |
| WO | WO 00/12243 | 3/2000 |
| WO | WO 00/64609 | 11/2000 |
| WO | WO 01/41948 | 6/2001 |
| WO | WO 02/43895 | 6/2002 |
| WO | WO 02/068281 | 9/2002 |
| WO | WO 03/059764 | 7/2003 |
| WO | WO 2005/032953 | 4/2005 |
| WO | WO 2007/005564 | 1/2007 |

* cited by examiner

CONTAINER END CLOSURE HAVING IMPROVED CHUCK WALL WITH STRENGTHENING BEAD AND COUNTERSINK

This application is a Divisional of U.S. patent application Ser. No. 11/235,827, filed Sep. 26, 2005, which claims the benefit of U.S. Provisional Patent Application Ser. No. 60/613,988, filed Sep. 27, 2004, the entire disclosures of which being incorporated herein.

FIELD OF THE INVENTION

The present invention generally relates to containers and container end closures, and more specifically metallic beverage container end closures adapted for interconnection to a beverage can body.

BACKGROUND OF THE INVENTION

Containers and more specifically metallic beverage containers are typically manufactured by interconnecting a beverage can end closure on a beverage container body. In some applications, an end closure may be interconnected on both a top side and a bottom side of a can body. More frequently, however, a beverage can end closure is interconnected on a top end of a beverage can body which is drawn and ironed from a flat sheet of blank material such as aluminum. Due to the potentially high internal pressures generated by carbonated beverages, both the beverage can body and the beverage can end closure are typically required to sustain internal pressures exceeding 90 psi without catastrophic and permanent deformation. Further, depending on various environmental conditions such as heat, over fill, high CO2 content, and vibration, the internal pressure in a typical beverage can may at times exceed 100 psi.

Thus, beverage can bodies and end closures must be durable to withstand high internal pressures, yet manufactured with extremely thin and durable materials such as aluminum to decrease the overall cost of the manufacturing process and the weight of the finished product. Accordingly, there exists a significant need for a durable beverage container end closure which can withstand the high internal pressures created by carbonated beverages, and the external forces applied during shipping, yet which is made from durable, lightweight and extremely thin metallic materials with geometric configurations which reduce material requirements. Previous attempts have been made to provide beverage container end closures with unique geometric configurations to provide material savings and improve strength, and a commonly used 202 B-64 end closure is shown in FIG. 11. One example of such an end closure is described in U.S. Pat. No. 6,065,634 To Crown Cork and Seal Technology Corporation, entitled "Can End and Method for Fixing the Same to a Can Body" (hereinafter the '634 Patent) and depicted as prior art in FIG. 12. In the beverage can end described in the '634 Patent, a chuck wall is provided which is inclined inwardly toward a countersink at an angle of between about 40° and 60°. Unfortunately, the beverage container end closure described in the '634 Patent has not proven to be completely reliable with regard to leaking, and does not utilize standard double seaming processes which are well known and used in the industry.

Other inventions known in the art have attempted to improve the strength of container end closures and save material costs by improving the geometry of the countersink region. Examples of these patents are U.S. Pat. No. 5,685,189 and U.S. Pat. No. 6,460,723 to Nguyen et al, which are incorporated herein in their entirety by reference. Another pending application which discloses other improved end closure geometry is disclosed in pending U.S. patent application Ser. No. 10/340,535, which was filed on Jan. 10, 2003 and is further incorporated herein in its entirety by reference.

The following disclosure describes an improved container end closure which is adapted for interconnection to a container body and which has an improved countersink, chuck wall geometry, and unit depth which significantly saves material costs, yet can withstand significant internal pressures.

SUMMARY OF THE INVENTION

Thus, in one aspect of the present invention, a container end closure is provided which can withstand significant internal pressures approaching 100 psi, yet saves between 3% and 10% of the material costs associated with manufacturing a typical beverage can end closure. Although the invention described herein generally applies to beverage containers and beverage end closures used to contain beer, soda and other carbonated beverages, it should be appreciated by one skilled in the art that the invention may also be used for any variety of applications which require the use of a container and interconnected container end closure. In one embodiment of the present invention, these attributes are achieved by providing a chuck wall with a substantially concave "arch", and a predetermined "transition zone" or strengthening bead which is positioned between the arch and the countersink, and which has a prominent and defined angle and length.

In another aspect of the present invention, a container end closure is provided which is manufactured with conventional manufacturing equipment and thus generally eliminates the need for expensive new equipment required to make the beverage can container end closure. Thus, existing and well known manufacturing equipment and processes can be implemented to quickly and effectively initiate the production of an improved beverage can container end closure in an existing manufacturing facility, i.e., can plant.

It is another aspect of the present invention to provide an end closure with an arcuate, non-linear shaped chuck wall, and which may include at least two distinct radius of curvatures. In one embodiment, a portion of the lowermost chuck wall is positioned above the upper chuck wall which has a different radius of curvature. As used in the prior art, the term "chuck wall" generally refers to the portion of the end closure located between the countersink and the circular end wall (or peripheral curl or flange that forms the double seam with the can body) and which is contacted by or engaged with the chuck during seaming, as shown in FIG. 7 of the Crown '634 patent. Unlike the prior art, the seaming chuck used in seaming the end closures of the present invention does not necessarily contact or engage with the entire chuck wall during the forming operation. Rather, to avoid scuffing the end closure, a portion of the chuck wall may not be contacted by the chuck drive surface during double seaming of the end closure to the neck of the container body, but rather only a selected portion of the chuck wall is engaged with the chuck during rotation and the double seaming process.

In another aspect of the present invention, a beverage can end closure is provided with a countersink having an inner panel wall with a distinct non-linear, outwardly oriented radius of curvature of between about 0.025 inches and 0.080 inches. As referred to herein, the term "outwardly" refers to a direction oriented generally toward the container neck or sidewalls, while "inwardly" generally refers to a direction away from the container neck or sidewalls. Preferably, the curved portion of the inner panel wall is positioned just below the point of interconnection with the central panel, and has been shown to improve the strength of the end closure.

It is another aspect of the present invention to provide a beverage can end closure which saves material costs by reducing the size of the blank material and/or utilizing thinner materials which have improved aluminum alloy properties. Thus, the integrity and strength of the beverage can end closure is not compromised, while material costs are significantly reduced as a result of the blank reduction, and/or improved aluminum alloy properties provided therein.

It is a further aspect of the present invention to provide a beverage can container end closure with an upper chuck wall having a first radius of curvature "Rc1" and a lower chuck wall having a second radius of curvature "Rc2". In another aspect of the present invention, a "transition zone" may be positioned in either the upper chuck wall portion, the lower chuck wall portion, or substantially therebetween. The transition zone is generally a chuck wall portion with a "kink" or distinctive change in a radius of curvature over a very specified and generally very short portion of the chuck wall, and typically with a length no greater than about 0.005 to 0.010 inches, and preferably about 0.008 inches.

Alternatively, the upper and lower chuck wall may be substantially "curvilinear," and thus have such a moderate degree of curvature that it almost resembles a straight line, i.e., linear. Further, the unit depth between an uppermost portion of a circular end wall and a lowermost portion of the countersink has a dimension in one embodiment of between about 0.215 and 0.280 inches, and more preferably about 0.250-0.260 inches. Further, in one aspect of the present invention, the inner panel wall may additionally have a non-linear radius of curvature, which is preferably about 0.025-0.080 inches, and more preferably about 0.050 inches.

It is yet a further aspect of the present invention to reduce the distance between the inner and outer panel walls of the countersink, and to thus save material costs while additionally improving the strength of the end closure. Thus, in one embodiment of the present invention the distance between the inner and outer panel walls is between about 0.045 inches and 0.055 inches, and more preferably about 0.052 inches.

It is yet another aspect of the present invention to provide an end closure with a chuck wall with superior strength when compared to a conventional container end closure, and which can withstand significant internal pressure. Thus, in one embodiment of the present invention an end closure is provided with a chuck wall having an outwardly projecting concave arch, and which in one embodiment is positioned approximately mid-way between the countersink and the circular end wall prior to double seaming the can end to a container body. Preferably, the chuck wall arch has a radius of curvature between about 0.015 inches and 0.080, and more preferably less than about 0.040 inches, and must be preferably about 0.0180-0.025 inches. In one embodiment, the upper chuck wall and lower chuck wall may be substantially linear, or have only a gradual radius of curvature, and may include one or more transition zones positioned therebetween.

Thus, in one aspect of the present invention, a metallic container end closure adapted for interconnection to a container body is provided, and comprises:

a circular end wall adapted for interconnection to a side wall of the container body;

a chuck wall integrally interconnected to said circular end wall and extending downwardly at an angle θ as measured from a vertical plane, said chuck wall further comprising an outwardly extending arch having a radius of curvature of between about 0.015 and 0.080 inches with a center point positioned below said circular end wall;

a countersink interconnected to a lower portion of said chuck wall and having a radius of curvature of less than about 0.020 inches;

a transition zone positioned between a lower portion of said outwardly extending arch and said countersink having a length of at least about 0.0090 inches and an angle distinct from said chuck wall or said countersink.

an inner panel wall interconnected to said countersink and extending upwardly at an angle ϕ of between about 0 degrees and 15 degrees as measured from a substantially vertical plane; and a central panel interconnected to an upper end of said inner panel wall and raised above a lowermost portion of said countersink.

Figures 5, 5A, 5B:
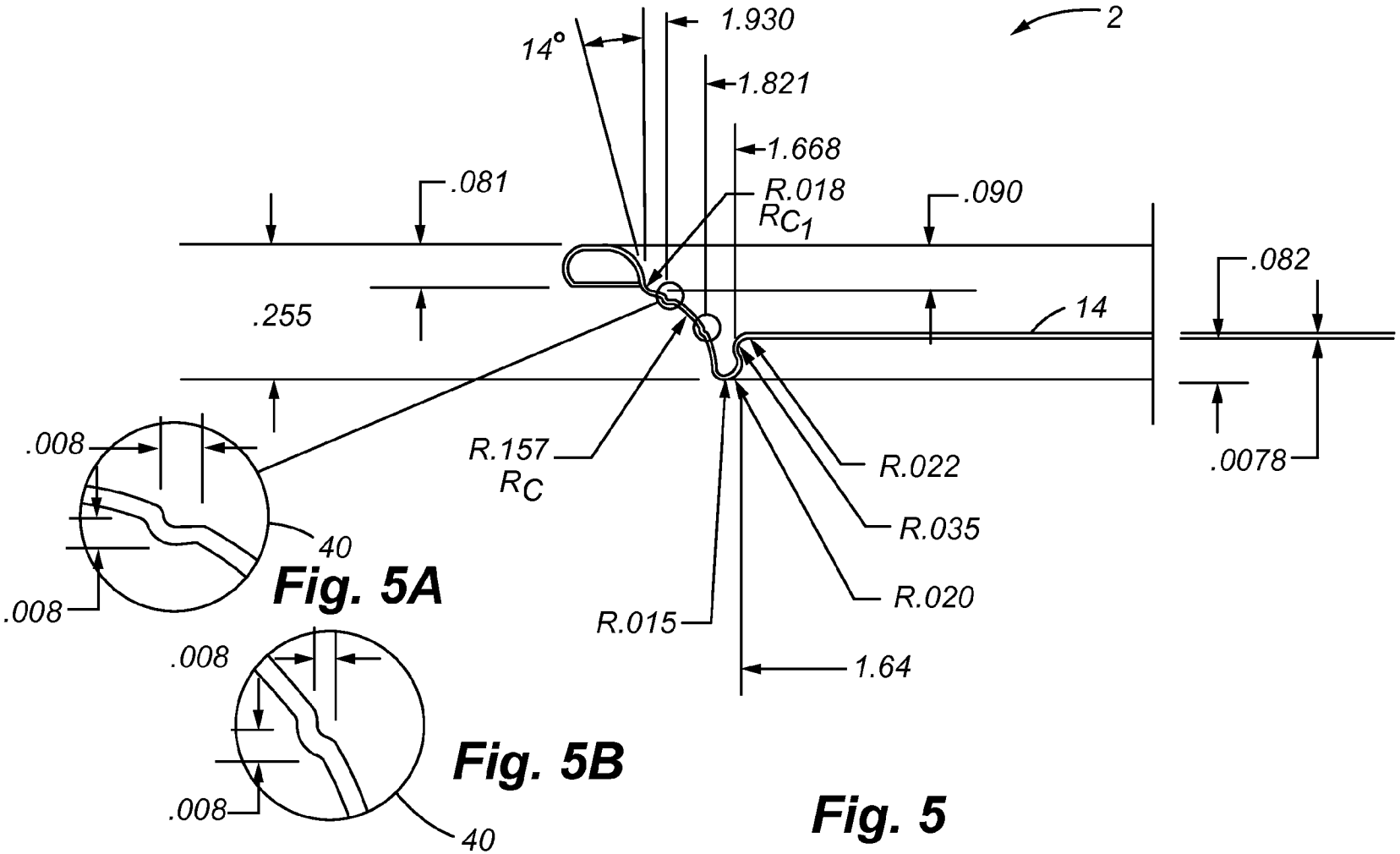
FIG. 5 is a cross-sectional, front elevation view of an alternative embodiment of the present invention.
FIG. 5A is a detailed view of FIG. 5.
Figure 6:
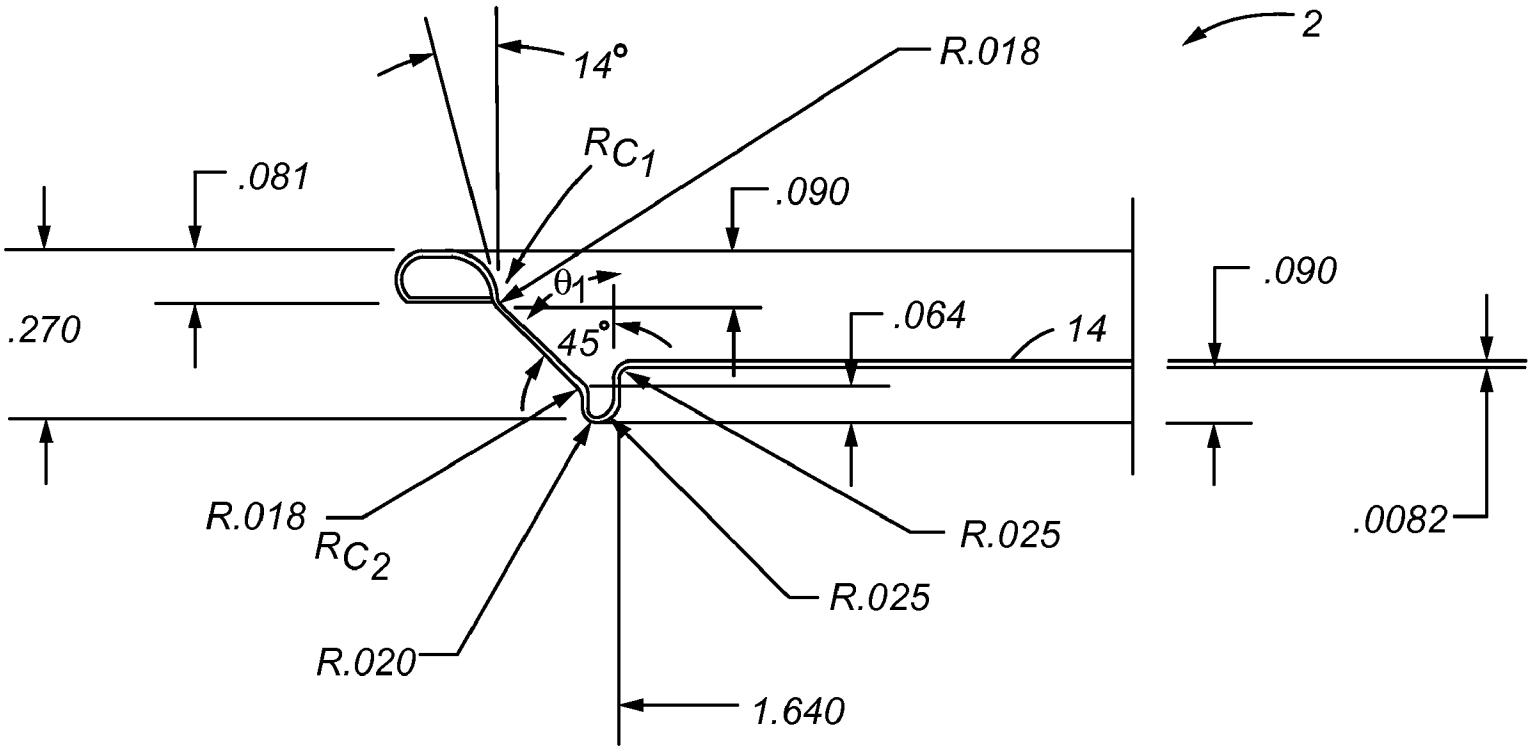
Figure 7:
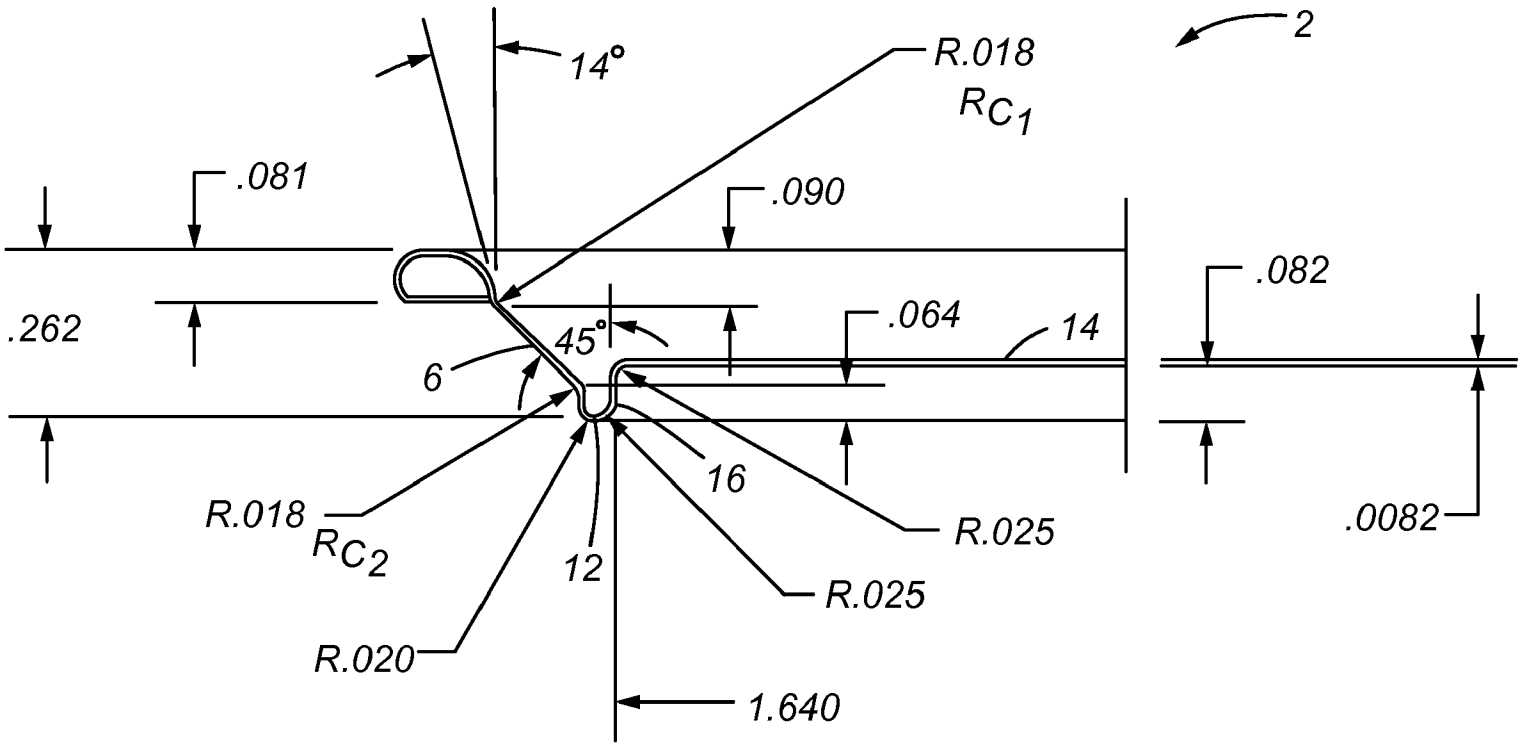
Figure 8:
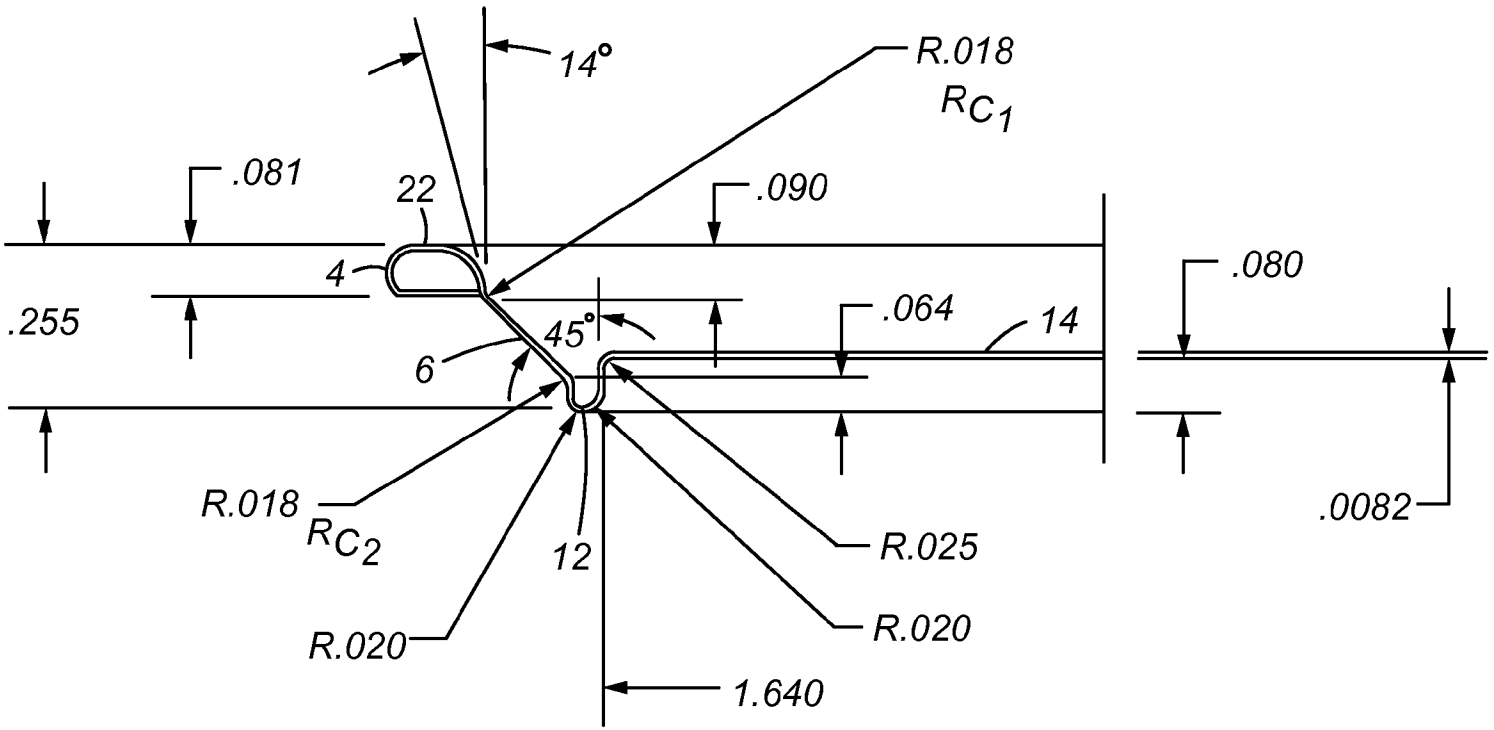
Figure 9:
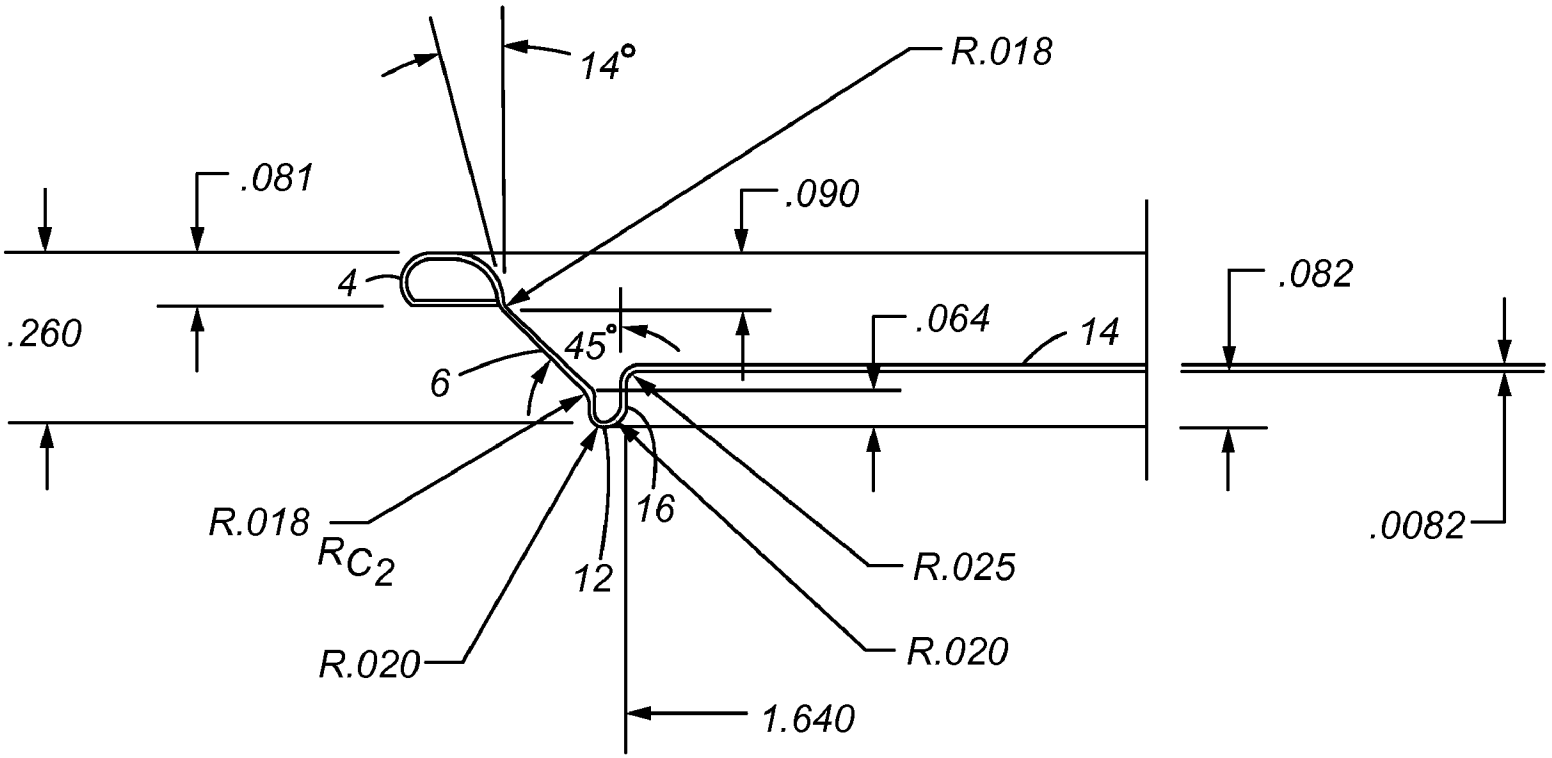
Figure 10:
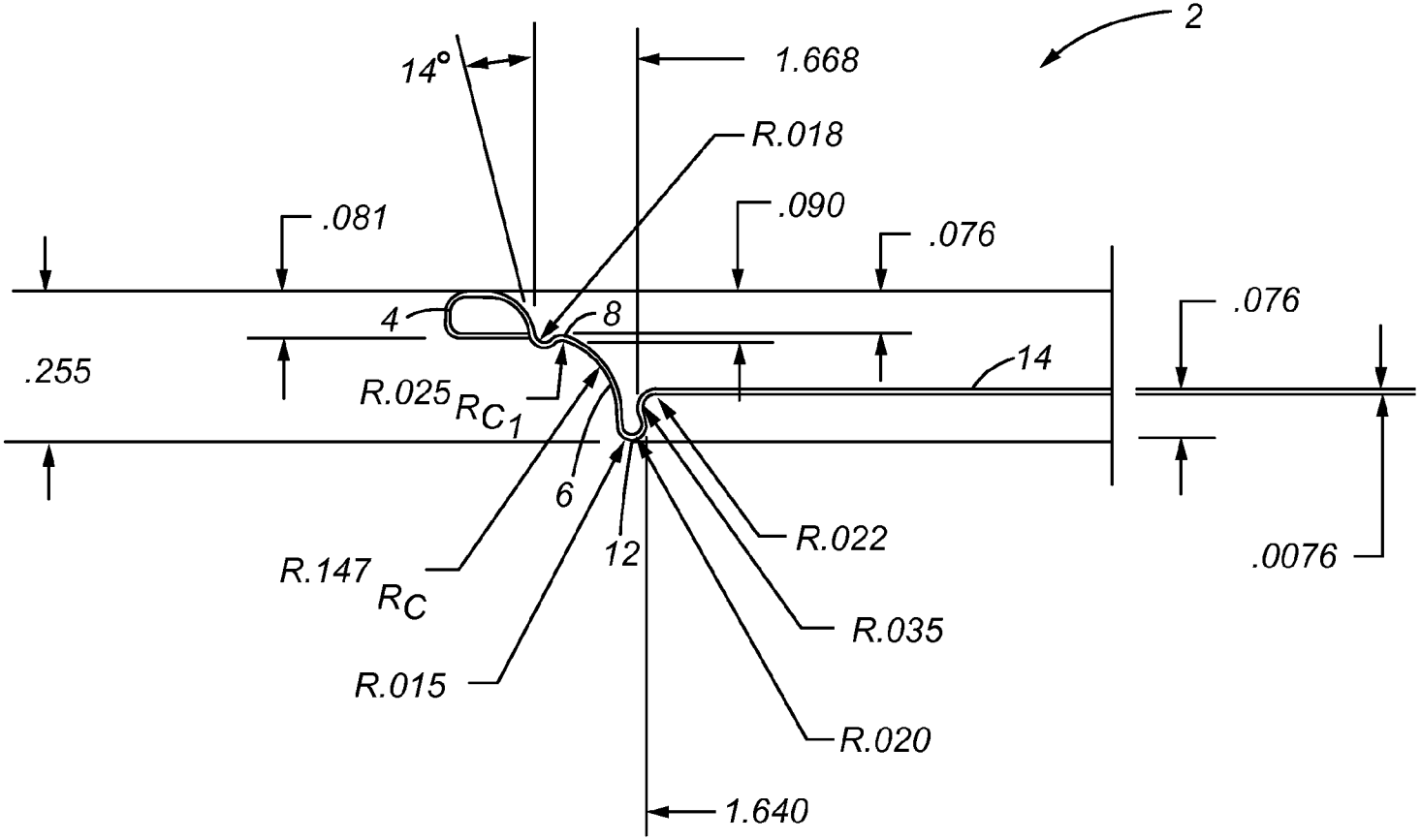
Figure 11:
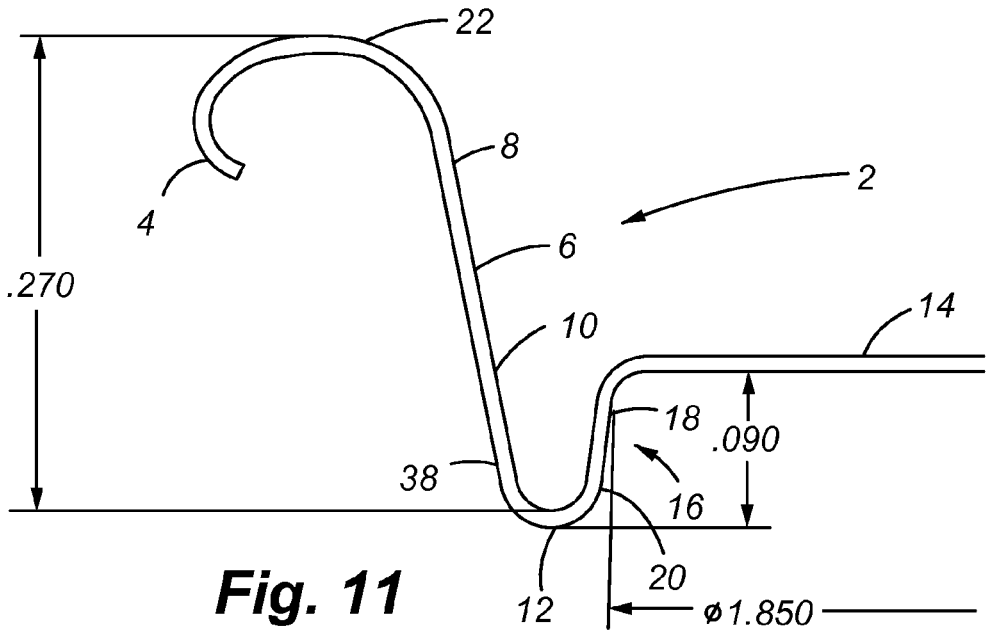
Fig. 11 Prior Art
Figure 12:
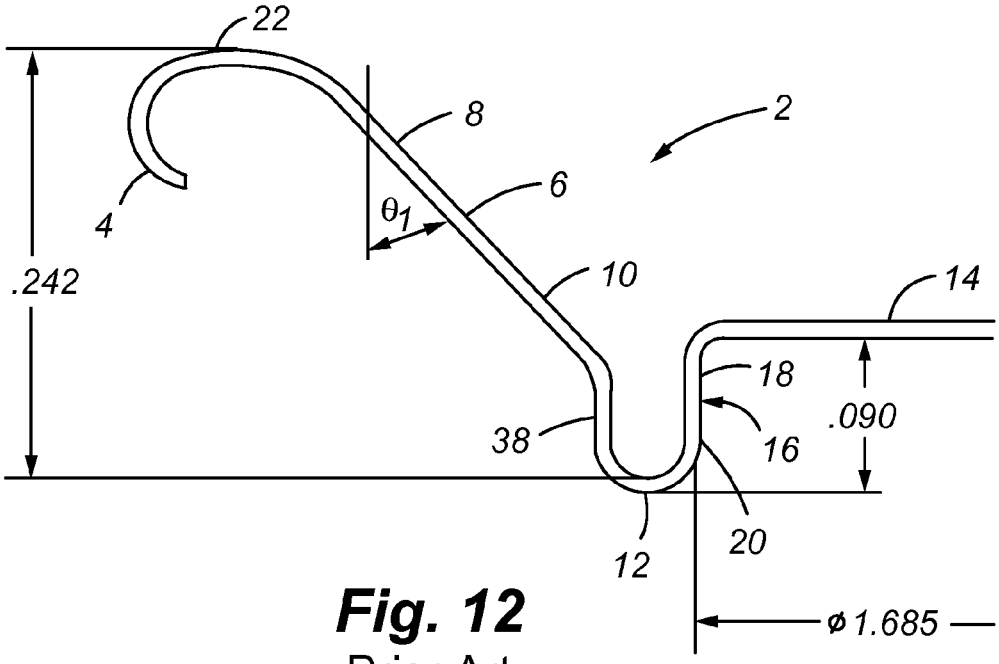
Fig. 12 Prior Art
Figure 13:
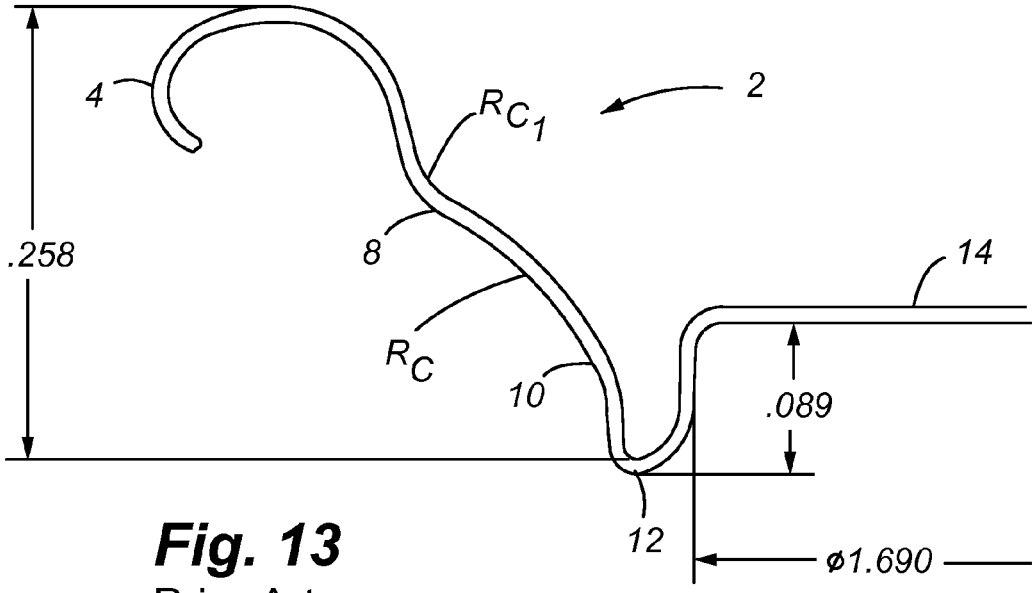
Fig. 13 Prior Art
Figure 14:
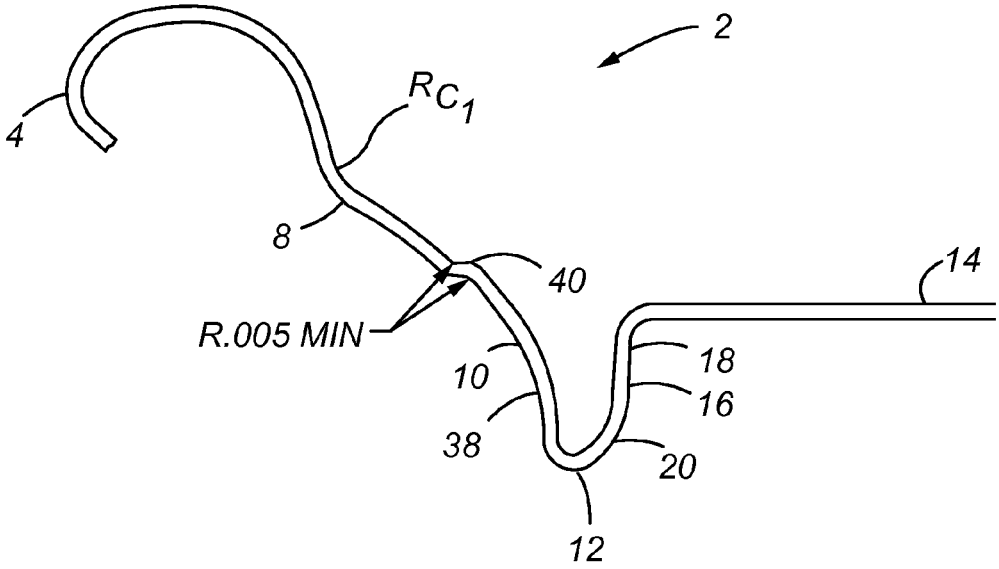
Figure 15:
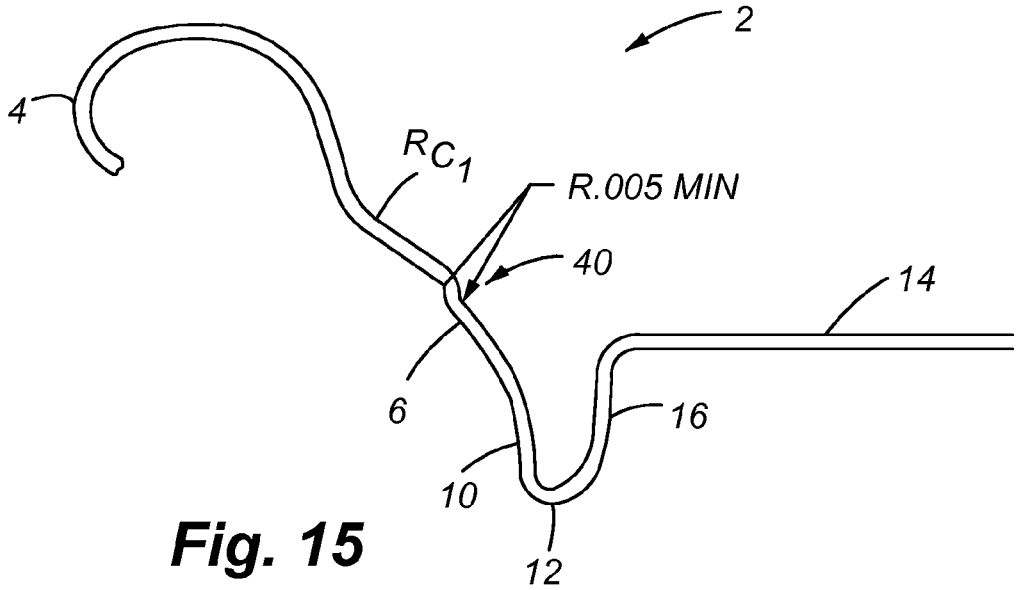
Figure 16:
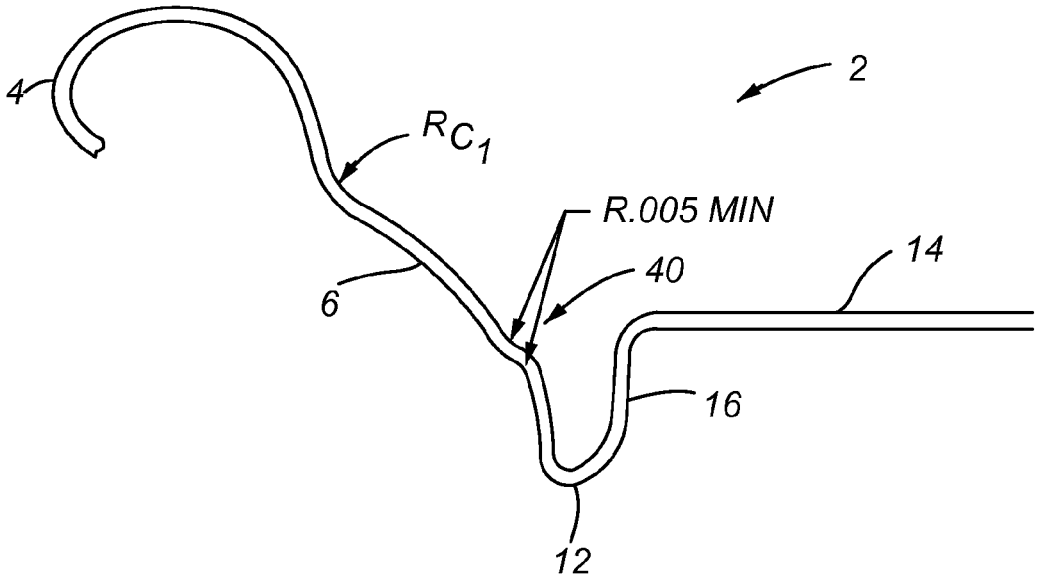
Figure 17:
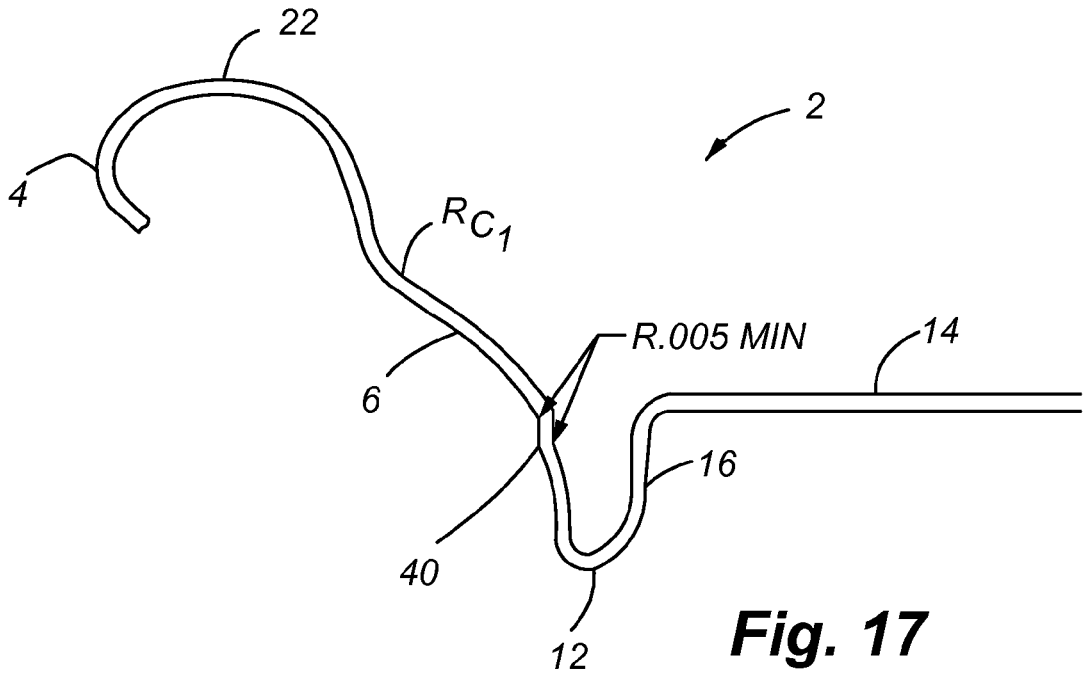
Figure 18:
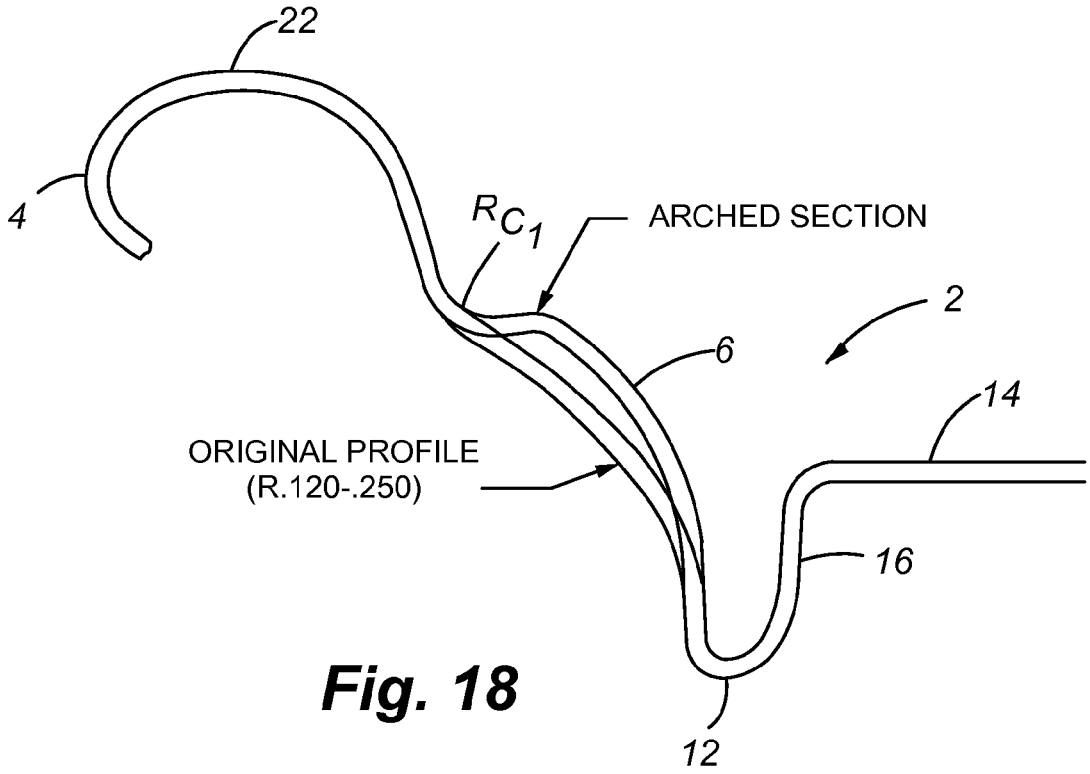
Figure 19:
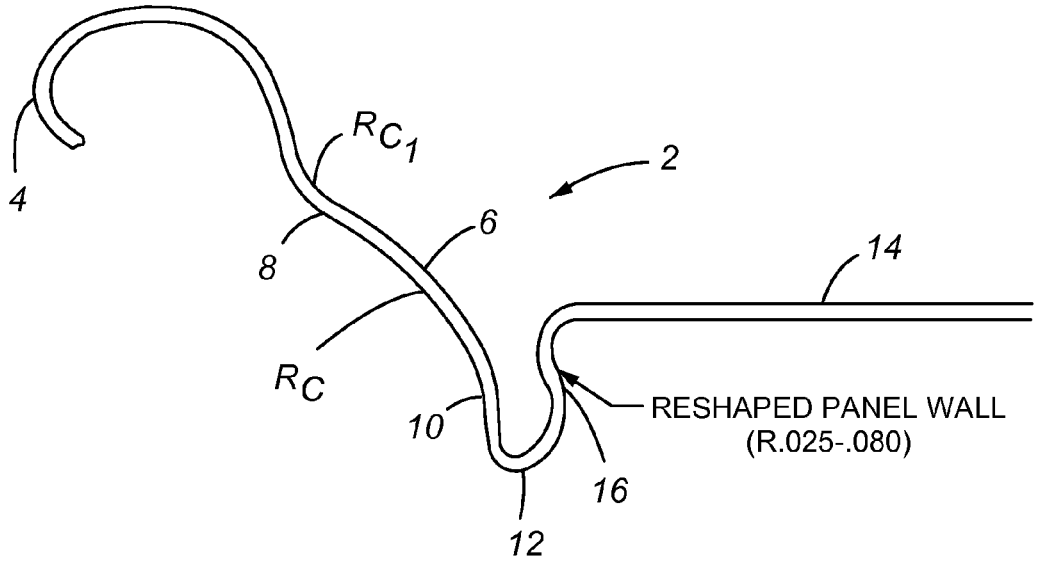
Figure 20:
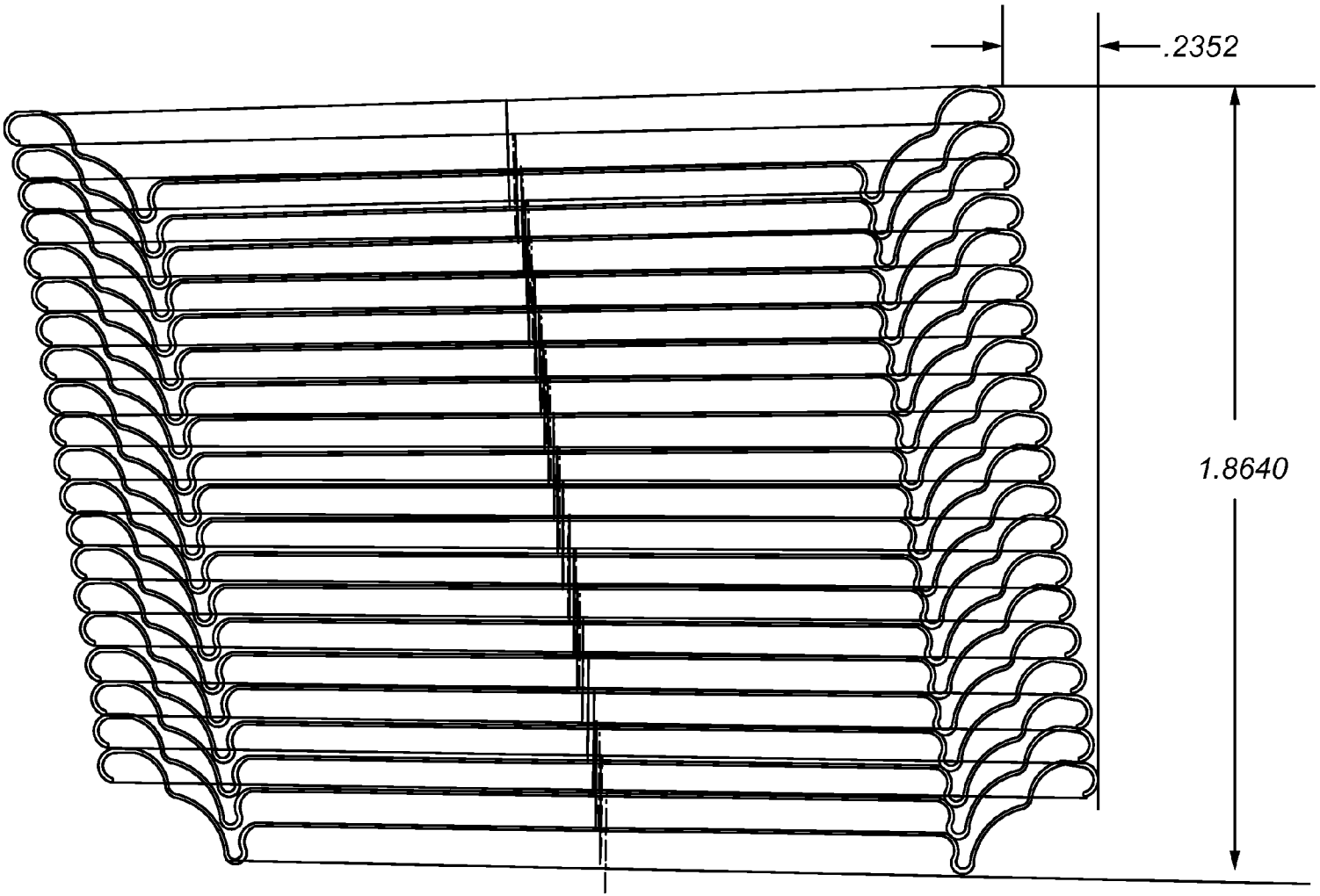

FIB. 5B is a detailed view of FIG. 5:

FIG. 6 is a cross-sectional, front elevation view of an alternative embodiment of the present invention;

FIG. 7 is a cross-sectional, front elevation view of an alternative embodiment of the present invention;

FIG. 8 is a cross-sectional, front elevation view of an alternative embodiment of the present invention;

FIG. 9 is a cross-sectional, front elevation view of an alternative embodiment of the present invention;

FIG. 10 is a cross-sectional, front elevation view of an alternative embodiment of the present invention;

FIG. 11 is a cross-sectional front elevation view of a standard 202 diameter beverage can end closure positioned before double seaming to a beverage can body;

FIG. 12 is a cross-sectional front elevation view of another prior art beverage can end positioned before double seaming to a beverage can body;

FIG. 13 is a cross sectional front elevation view of another prior art beverage can end positioned before double seaming to a beverage can body;

FIG. 14 is a cross-sectional, front elevation view of an alternative embodiment of the present invention;

FIG. 15 is a cross-sectional, front elevation view of an alternative embodiment of the present invention;

FIG. 16 is a cross-sectional, front elevation view of an alternative embodiment of the present invention;

FIG. 17 is a cross-sectional, front elevation view of an alternative embodiment of the present invention;

FIG. 18 is a cross-sectional, front elevation view of an alternative embodiment of the present invention;

FIG. 19 is a cross-sectional, front elevation view of an alternative embodiment of the present invention; and FIG. 20 is a cross-sectional front elevation view depicting a plurality of end closures shown in a stacked configuration.

DETAILED DESCRIPTION

Referring now to the drawings, FIGS. 1-10 represent alternative embodiments of the present invention, and identifying various geometries which may be incorporated in a beverage can end closure 2 to achieve superior performance including buckle resistance. Each of the geometries shown in FIGS. 1-10 may be utilized independently, or alternatively combined in one or more combinations. FIGS. 11-13 represent prior at end closures 2, while FIGS. 14-19 depict cross-sectional front elevation views of alternative embodiments of the present invention. FIG. 20 shows a stacking arrangement of one end closure of the present invention and identifying the amount of "shuffle," i.e. horizontal movement in a 2" vertical stack of end closures. With regard to FIGS. 1-10, and the geometries provided herein, a detailed chart of these end closures is provided herein in the specification, wherein the specific geometry for each end closure is provided as well as specific performance data. Additionally, the end closures are provided for comparison purposes.

Referring now to FIGS. 11-13, prior art end closures which are currently known in the art are provided herein, and which generally show the various components of an end closure 2. More specifically, these include a circular end wall 4 which is interconnected to a chuck wall 6, which may further be comprised of an upper chuck wall 8 and a lower chuck wall 10. The lower chuck wall 10 is generally interconnected to a countersink 12 which includes a countersink outer panel wall 38 and a countersink inner panel wall 16. The countersink inner panel wall 16 may be further comprised of an inner panel wall upper end 18 and an inner panel wall lower end 20 which may have distinct geometries. The upper end of the countersink inner panel wall 16 is generally connected to a central panel 14 which has a substantially vertical center of axis. The circular end wall 4 of the container end closure is generally interconnected to a container neck 26 (not shown) which is further interconnected to a container body 24. As provided herein in the drawings, the container end closure 2 of any one of the various embodiments may have a chuck wall radius of curvature Rc, an upper chuck wall radius of curvature Rc1, a lower chuck wall radius of curvature Rc2, an upper chuck wall angle $\theta_1$, a lower chuck wall angle $\theta_2$, an upper inner panel wall angle $\phi_1$, and a lower inner panel wall angle $\phi_2$.

Figure 1:
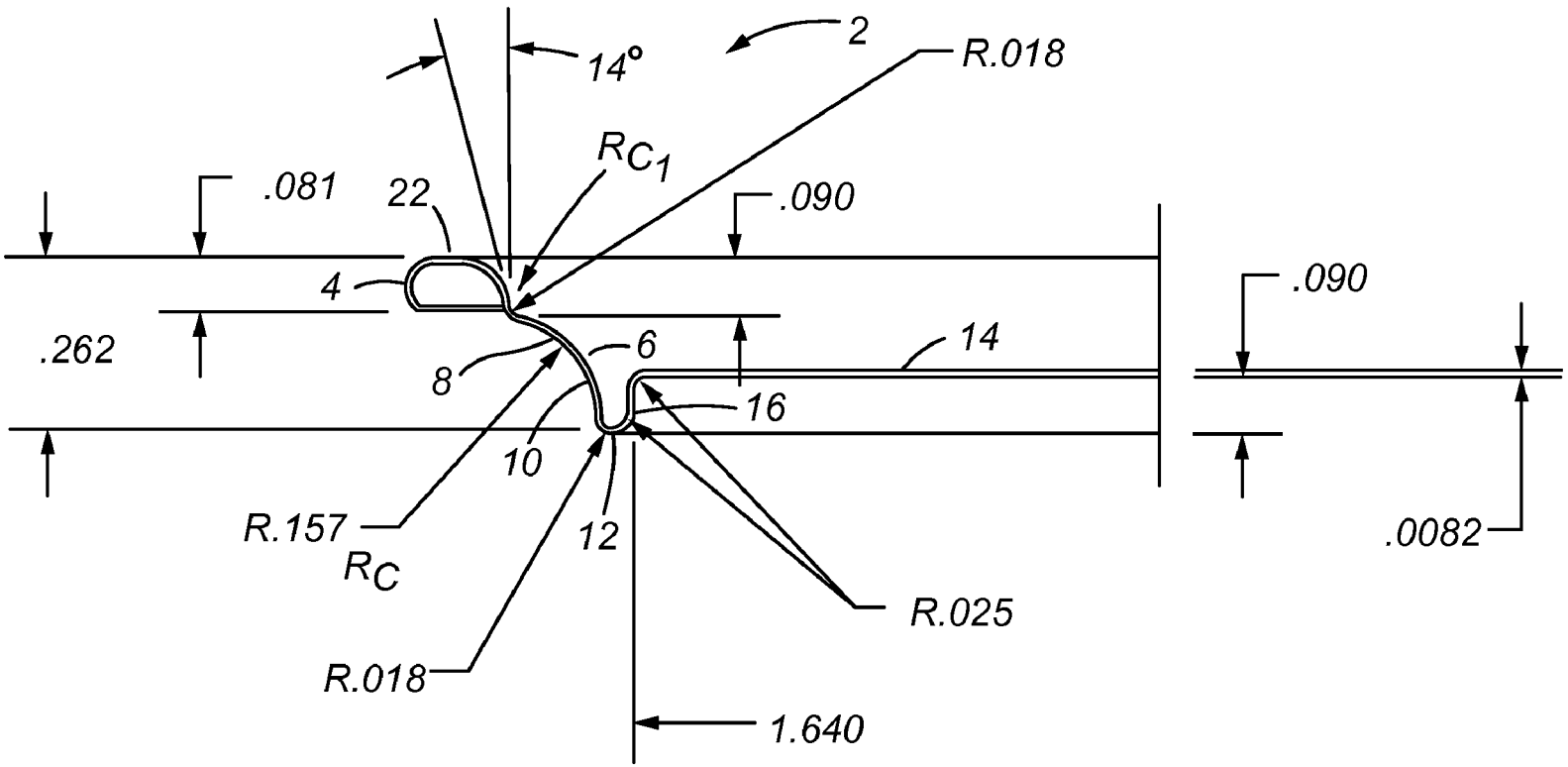
FIG. 1 is a cross-sectional, front elevation view of one embodiment of the present invention.

Referring now to FIG. 1, the cross sectional front elevation view of one embodiment of the present invention is provided herein, and which generally depicts a container end closure circular end wall 4 which has an uppermost portion identified as the crown 22. Extending inwardly from the crown 22 is a chuck wall 6 which is comprised of an upper chuck wall 8 and a lower chuck wall 10. The upper chuck wall 8 further includes a chuck wall arch 30 which is comprised of an outwardly oriented arcuate portion having a radius of curvature of about 0.018 inches. Furthermore, the lower chuck wall portion 10 is comprised of an inwardly oriented arch having a radius of curvature of about 0.157 inches. The lower chuck wall portion 10 is further interconnected to a countersink 12 which has a radius of curvature of about 0.18 inches, and which is further interconnected to an inner panel wall 16. The inner panel wall has two radius of curvatures, one on a lower end and one on an upper end which transitions into the central panel 14. Furthermore, the countersink has a depth of about 0.090 inches as measured from the central panel 14, and has a total depth as measured from the crown 22 of about 0.262 inches. Referring now to the test data provided in Appendix A, the end closure 2 identified in FIG. 1 is shown to have an ultimate end shell buckle value of 106 psi, which provides excellent buckle resistance to internal pressures.

Figure 2:
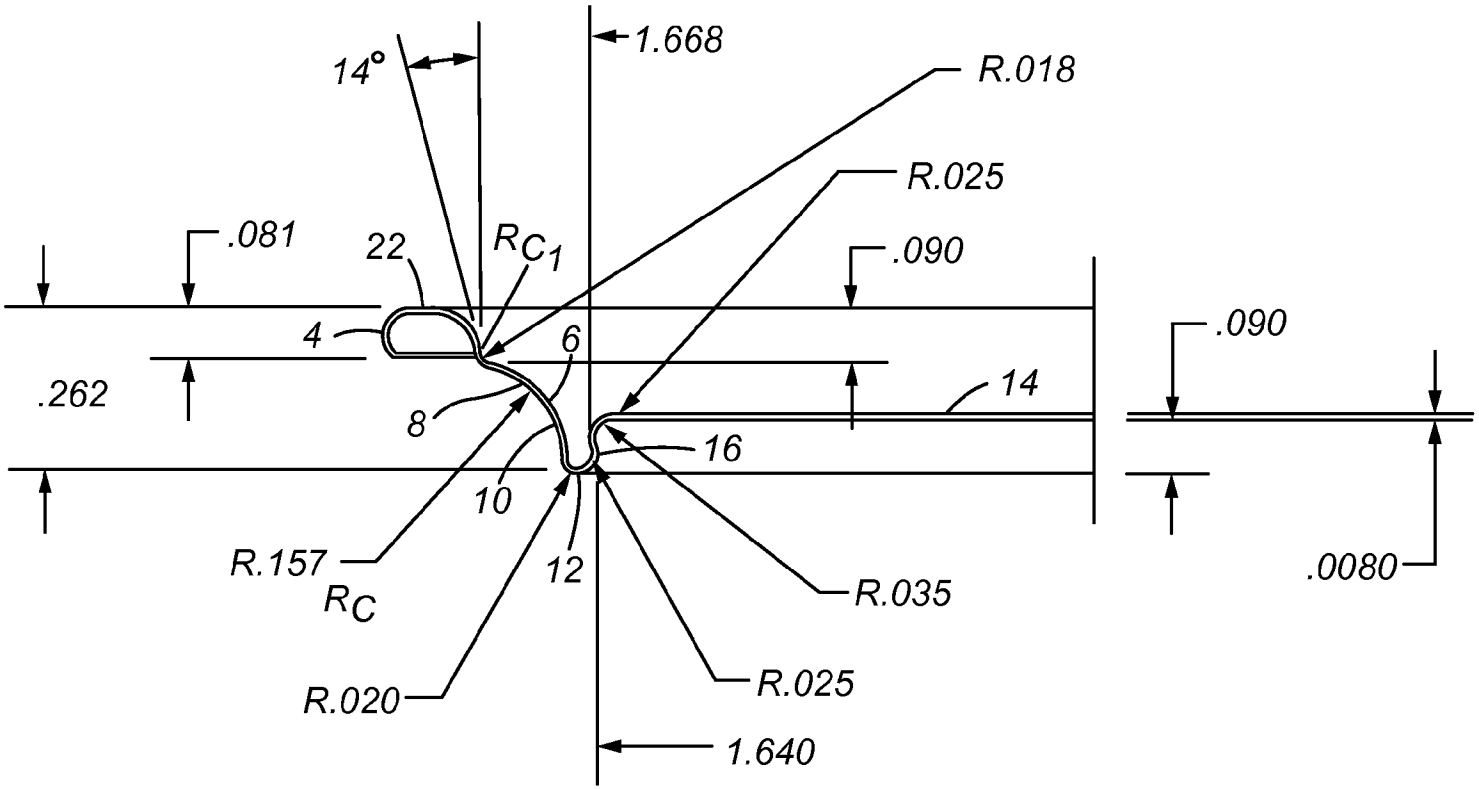
FIG. 2 is a cross-sectional, front elevation view of an alternative embodiment of the present invention.
Figure 3:
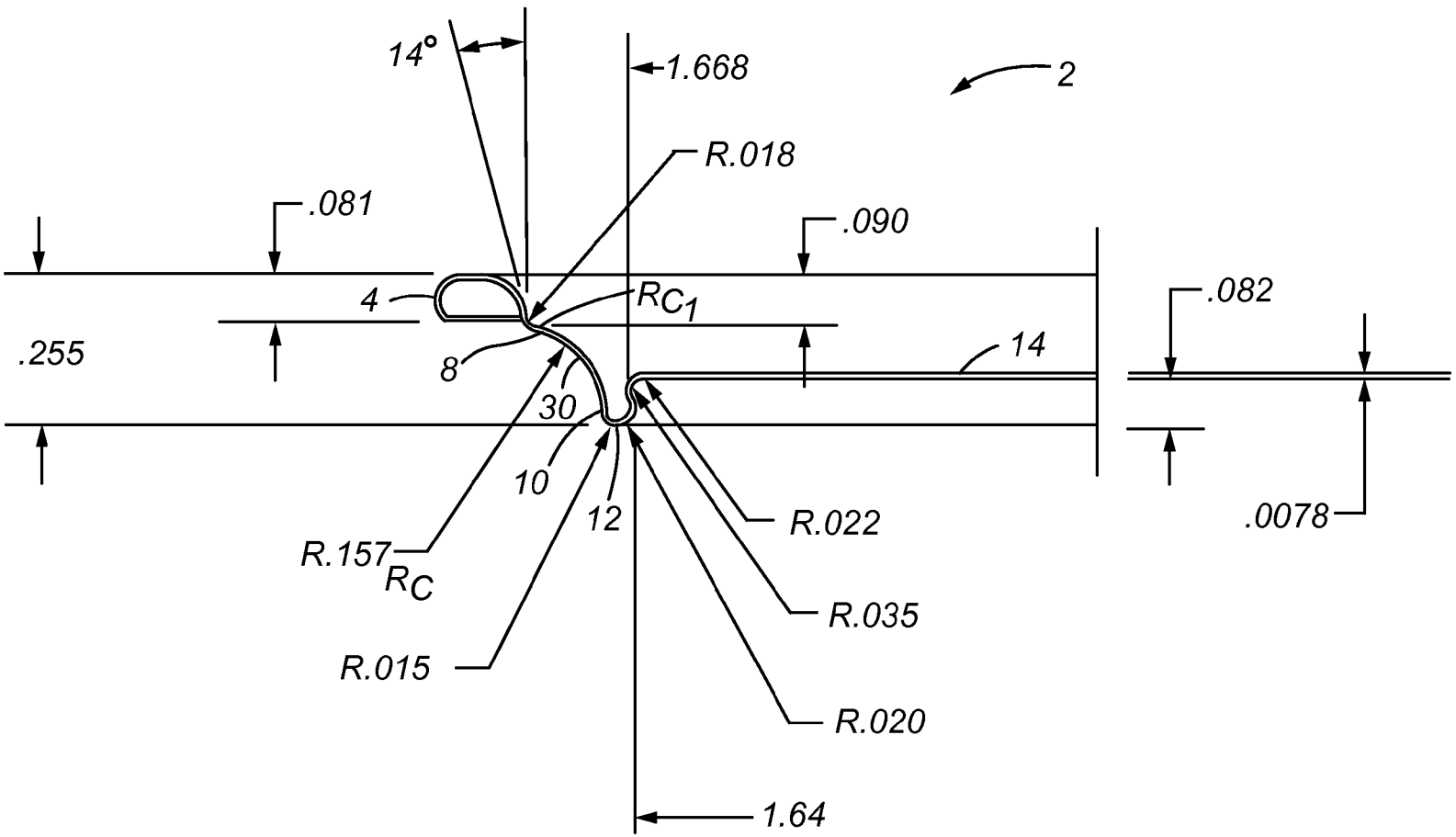
FIG. 3 is a cross-sectional, front elevation view of an alternative embodiment of the present invention.

Referring now to FIG. 2, an alternative embodiment of the present invention is provided herein, and which has a geometry slightly different than the embodiment shown in FIG. 1. More specifically, the countersink inner panel wall 16 has a radius of curvature of about 0.035 inches where the inner panel wall is interconnected to the central panel. When reviewing the performance data shown for FIG. 2, it can be seen that the end shell actually failed at an internal pressure of about 114 psi, which is a significant improvement over the prior art. The actual dimension of the end closure shown in FIG. 2, as well as the other embodiments provided herein are found in Appendix A which includes all of the performance data as well.

Figures 4, 4A:
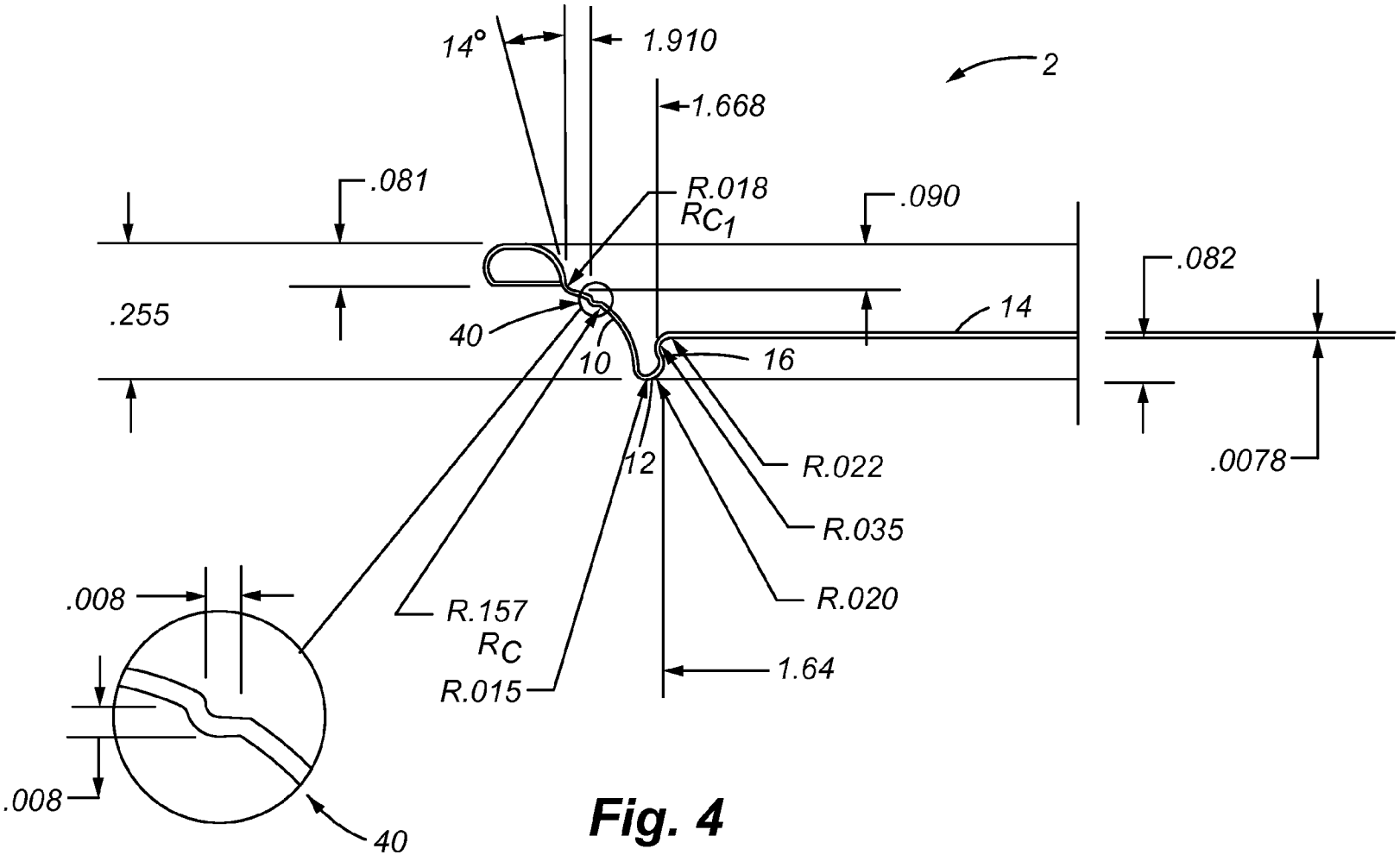
FIG. 4 is a cross-sectional, front elevation view of an alternative embodiment of the present invention.
FIG. 4A is a detailed view of FIG. 4.

Referring now to FIGS. 3-10, alternative embodiments of the present invention are provided herein. One end closure of note is shown in FIG. 4, which includes a transition zone 40 which is also depicted in FIB. 4*a*. More specifically, the transition zone is generally positioned between an upper chuck wall 8 and a lower chuck wall 10, and includes a portion with a specific "kink" or bend which has a distinct radius of curvature as compared to the upper chuck wall 8 and the lower chuck wall 10. As appreciated by one skilled in the art, the transition zone or zones may have a variety of geometries and orientations, another being identified in FIG. 5, wherein there may be more than one transition zones 40 present in the chuck wall 6.

Referring now to FIGS. 5, 5A, and 5B, an alternative embodiment of the present invention is provided herein wherein two distinct transition zones are positioned in the chuck wall between the chuck wall upper portion and the chuck wall lower portion. As provided in the detailed views of FIG. 5, each of the transition zones 40 comprise a portion which has a width of approximately 0.008 inches and a height of 0.008 inches. As appreciated by one skilled in the art, these dimensions may be greater or lower depending on the specific chuck wall geometry, and the application related thereto.

Referring now to FIG. 6, an alternative embodiment of the present invention is provided herein wherein the chuck wall has a substantially linear portion which is interconnected to a lower portion of the peripheral cover hook at a radius $R_C$1 which is in this embodiment approximately 0.018 inches. As appreciated by one skilled in the art, this radius may vary between about 0.010 inches and 0.040 inches depending on the application for the beverage container end closure 2.

Referring now to FIG. 7, an alternative embodiment of the end closure 2 of the present invention is provided herein. More specifically, the chuck wall 6 is oriented at an angle of about 45°, while the central panel 14 is positioned above the lower chuck wall 10. More specifically, the central panel 14 is positioned above a lowermost portion of the countersink 12 preferably about 0.082 inches, and between the range of about 0.050 inches and 0.090 inches. Furthermore, the countersink 12 radius is between about 0.020 inches and 0.040 inches, and wherein the countersink inner panel wall 16 is interconnected to the central panel 14 with a radius of curvature of about 0.025 inches. Variations of FIG. 7 can be shown in FIGS. 8-9, wherein the dimensions are slightly different but the general configuration of the end closure 2 are similar.

Referring now to FIG. 10, an alternative embodiment of the present invention is provided herein wherein the chuck wall 6 has a substantial radius of curvature $R_C$ of approximately 0.147 inches. Furthermore, the upper chuck wall $R_C$1 has a radius of curvature of approximately 0.025 inches and which provides a distinct point of interconnection with the peripheral cover hook 4 to define a radius of curvature of about 0.018 inches. As further depicted in FIG. 10, the upper chuck wall 8 is positioned above the radius of curvature interconnecting the upper chuck wall to the circular end wall 4. As further shown in FIG. 10, the countersink inner panel wall 16 has an arcuate shape, and wherein the upper portion has a radius of curvature in this embodiment as 0.035 inches.

Referring now to FIGS. 11-13, the prior art end closures provided herein are for reference purposes only and are provided to shown various prior art end closure designs currently used or generally known in container beverage industry.

With regard to FIGS. 14-19, cross-sectional front elevation views of alternative embodiments of the present invention are provided herein, and which show variations in the chuck wall arch 30, and the transition zones 40.

Referring now to FIG. 20, the cross-sectional front elevation view is shown of the stacking of one embodiment of the present invention, and which identifies the shuffle, i.e., horizontal travel of a 2" height of end closures. As shown herein, with a vertical height of 1.8640 inches, the horizontal movement is 0.2352 inches.

The end closures provided herein in the drawings are generally drawn and ironed from a substantial planar piece of metal, commonly aluminum, and formed into the distinct shapes with the geometry shown herein. As appreciated by one skilled in the art, the presses and dies used to form these end closures are commonly known in the art and generally provide support on various portions of an outer surface and inner surface of the end closure to create a preferred geometry. In some embodiments a "free forming" method of double seaming may be employed as disclosed in pending U.S. patent application Ser. No. 11/192,978, which is incorporated herein in its entirety by reference.

The geometry and performance data for each of the end closures provided in FIGS. 1-10 are provided herein, and include pressure testing with the end closure double seamed to a container.

TEST DATA FOR END SHELLS SEAMED ON CANS

| | |
|---|---|
| Aluminum Alloy | 5182 |
| Metal Gauge | 0.0082" |
| Outside Diameter | 2.342" |
| Unit Depth | 0.262" |
| Panel Depth | 0.090" |
| Panel Diameter | 1.640 W |
| Curl Height | 0.081" |
| Countersink Radius | 0.020" |
| Chuck Wall Intersection Radius | 0.018" |
| Chuck Wall Angle | 14 degrees |
| Depth of Chuck Wall | 0.091" |
| Inner Panel Wall Radius | 0.025" |
| Inner Countersink Radius | 0.025" |
| Circumferential Chuck wall Dome Radius | 0.157" |

Note:
End Shell Buckle and Ultimate Failure was at 106 psi.

Center Panel Bulge Values Pressure in psi

| psi | Center Panel Deflection |
|---|---|
| 40 lbs | 0.015" |
| 50 lbs | 0.021" |
| 60 lbs | 0.038" |
| 70 lbs | 0.053" |
| 80 lbs | 0.059" |
| 90 lbs | 0.072" |
| 100 lbs | 0.079" |

TEST DATA FOR END SHELL VERSION #2

| | |
|---|---|
| Aluminum Alloy | 5182 |
| Metal Gauge | 0.0080" |
| Outside Diameter | 2.342" |
| Unit Depth | 0.262" |
| Panel Depth | 0.090" |
| Panel Diameter | 1.640" |
| Curl Height | 0.081" |
| Countersink Radius | 0.020" |
| Chuck Wall Intersection Radius | 0.018" |
| Chuck Wall Angle | 14 degrees |
| Depth of Chuck Wall | 0.091" |
| Inner Panel Wall Radius | 0.025" |
| Inner Countersink Radius | 0.025" |
| Inner panel wall Dome Radius | 0.035" |
| Circumferential Dome Radius | 0.157" |

Performance Criteria - Center Panel Bulge
Values Pressure in LBS. Rise

| psi | Center Panel Deflection |
|---|---|
| 40 lbs | 0.017" |
| 50 lbs | 0.024" |
| 60 lbs | 0.041" |
| 70 lbs | 0.056" |
| 80 lbs | 0.064" |
| 90 lbs | 0.079" |
| 100 lbs | 0.083" |

Note:
End shell buckle and ultimate failure at 114 psi.

CIRCUMFERENTIAL DOME ANNULUS END SHELL VERSION #3

| | |
|---|---|
| Aluminum Alloy | 5182 |
| Metal Gauge | 0.0078" |
| Outside Diameter | 2.342" |
| Unit Depth | 0.255" |
| Panel Depth | 0.082" |
| Panel Diameter | 1.640" |
| Curl Height | 0.081" |
| Countersink Radius | 0.015" |
| Chuck Wall Intersection Radius | 0.018" |
| Chuck Wall Angle | 14 degrees |
| Depth of Chuck Wall | 0.091" |
| Inner Panel Wall Radius | 0.022" |
| Inner Countersink Radius | 0.020" |
| Inner panel wall Dome Radius | 0.035" |
| Circumferential Dome Radius | 0.152" |

Performance Criteria
Center Panel Bulge Values Pressure in psi

| psi | Center Panel Deflection |
|---|---|
| 40 lbs | 0.0185" |
| 50 lbs | 0.027" |
| 60 lbs | 0.046" |
| 70 lbs | 0.067" |
| 80 lbs | 0.072" |
| 90 lbs | 0.084" |
| 100 lbs X | |

Note:
End Shell Buckle and Ultimate Failure was at 93 psi.

| CIRCUMFERENTIAL DOME ANNULUS END SHELL VERSION #4 | |
|---|---|
| Aluminum Alloy | 5182 |
| Metal Gauge | 0.0078" |
| Outside Diameter | 2.342" |
| Unit Depth | 0.255" |
| Panel Depth | 0.082" |
| Panel Diameter | 1.640 W |
| Curl Height | 0.081" |
| Countersink Radius | 0.015" |
| Chuck Wall Intersection Radius | 0.018" |
| Chuck Wall Angle | 14 degrees |
| Depth of Chuck Wall | 0.091" |
| Inner Panel Wall Radius | 0.022" |
| Inner Countersink Radius | 0.020" |
| Inner panel wall Dome Radius | 0.035" |
| Circumferential Dome Radius | 0.152" |

Performance Criteria
Center Panel Bulge Values Pressure in psi

| psi | Center Panel Deflection |
|---|---|
| 40 lbs | 0.016" |
| 50 lbs | 0.024" |
| 60 lbs | 0.038" |
| 70 lbs | 0.059" |
| 80 lbs | 0.071" |
| 90 lbs | 0.086" |
| 100 lbs X | |

End shell buckle Pressure (Failure) Fully Aged End Shell = 97 lbs.

| CIRCUMFERENTIAL DOME ANNULUS END SHELL VERSION #5 | |
|---|---|
| Aluminum Alloy | 5182 |
| Metal Gauge | 0.0078" |
| Outside Diameter | 2.342" |
| Unit Depth | 0.255" |
| Panel Depth | 0.082" |
| Panel Diameter | 1.640" |
| Curl Height | 0.081" |
| Countersink Radius | 0.015" |
| Chuck Wall Intersection Radius | 0.018" |
| Chuck Wall Angle | 14 degrees |
| Depth of Chuck Wall | 0.091" |
| Inner Panel Wall Radius | 0.022" |
| Inner Countersink Radius | 0.020" |
| Inner panel wall Dome Radius | 0.035" |
| Circumferential Dome Radius | 0.152" |

Performance Criteria
Center Panel Bulge Values Pressure in psi

| psi | Center Panel Deflection |
|---|---|
| 40 lbs | 0.0145" |
| 50 lbs | 0.022" |
| 60 lbs | 0.035" |
| 70 lbs | 0.054" |
| 80 lbs | 0.066" |
| 90 lbs | 0.082" |
| 100 lbs | 0.089" |

End shell buckle Pressure (Failure) Fully Aged = 102 lbs.

| FLAT ANGLE ANNULUS (CHUCK PANEL) END SHELL VERSION #6 | |
|---|---|
| Aluminum Alloy | 5182 |
| Metal Gauge | 0.0082" |
| Outside Diameter | 2.342" |
| Unit Depth | 0.270" |
| Panel Depth | 0.090" |
| Panel Diameter | 1.640 W |
| Curl Height | 0.081" |
| Countersink Radius | 0.020" |
| Chuck Panel Angle | 45 degrees |
| Chuck Wall Angle | 14 degrees |
| Depth of Chuck Wall | 0.091" |
| Inner Panel Wall Radius | 0.025" |
| Inner Countersink Radius | 0.025" |
| Depth of Outer Panel wall | 0.065" |

Performance Criteria
Center Panel Bulge Values Pressure in psi

| psi | Center Panel Deflection |
|---|---|
| 40 lbs | 0.0265" |
| 50 lbs | 0.0435" |
| 60 lbs | 0.0565" |
| 70 lbs | 0.0645" |
| 80 lbs | 0.0756" |
| 90 lbs | 0.0825" |

End Shell Buckle and Ultimate Failure = 93 lbs.

| FLAT ANGLE ANNULUS (CHUCK PANEL) END SHELL VERSION #7 | |
|---|---|
| Aluminum Alloy | 5182 |
| Metal Gauge | 0.0082" |
| Outside Diameter | 2.342" |
| Unit Depth | 0.262" |
| Panel Depth | 0.082" |
| Panel Diameter | 1.640 W |
| Curl Height | 0.081" |
| Countersink Radius | 0.020" |
| Chuck Panel Angle | 45 degrees |
| Chuck Wall Angle | 14 degrees |
| Depth of Chuck Wall | 0.091" |
| Inner Panel Wall Radius | 0.025" |
| Inner Countersink Radius | 0.025" |
| Depth of Outer Panel Wall | 0.065 |

Performance Criteria
Center Panel Bulge Values Pressure in psi

| psi | Center Panel Deflection |
|---|---|
| 40 lbs | 0.0314" |
| 50 lbs | 0.0485" |
| 60 lbs | 0.0635" |
| 70 lbs | 0.0780" |
| 80 lbs | 0.0825" |
| 90 lbs X | |

End Shell Buckle and Ultimate Failure 87 lbs.

| FLAT ANGLE ANNULUS (CHUCK PANEL) END SHELL VERSION #8 | |
|---|---|
| Aluminum Alloy | 5182 |
| Metal Gauge | 0.0082" |
| Outside Diameter | 2.342" |
| Unit Depth | 0.255" |
| Panel Depth | 0.080" |
| Panel Diameter | 1.640" |
| Curl Height | 0.081" |
| Countersink Radius | 0.015" |
| Chuck Panel Angle | 45 Degrees |
| Chuck Wall Angle | 14 Degrees |
| Depth of Chuck Wall | 0.091" |
| Inner Panel Wall Radius | 0.025" |
| Inner Countersink Radius | 0.020" |
| Depth of Outer Panel Wall | 0.065" |

| Performance Criteria Center Panel Bulge Values Pressure in psi | |
|---|---|
| psi | Center Panel Deflection |
| 40 lbs | 0.0370" |
| 50 lbs | 0.0510" |
| 60 lbs | 0.0710" |
| 70 lbs | 0.0815" |
| 80 lbs | 0.0885" |
| 90 lbs X | |

End Shell Buckle and Ultimate Failure = 82 lbs.

| FLAT ANGLE ANNULUS (CHUCK PANEL) END SHELL VERSION #9 | |
|---|---|
| Aluminum Alloy | 5182 |
| Metal Gauge | 0.0082" |
| Outside Diameter | 2.342" |
| Unit Depth | 0.260" |
| Panel Depth | 0.082" |
| Panel Diameter | 1.640 W |
| Curl Height | 0.081" |
| Countersink Radius | 0.020" |
| Chuck Panel Angle | 45 Degrees |
| Chuck Wall Angle | 14 degrees |
| Depth of Chuck Wall | 0.091 |
| Inner Panel Wall Radius | 0.025" |
| Inner Countersink Radius | 0.020" |
| Depth of Outer Panel Wall | 0.065" |

| Performance Criteria Center Panel Bulge Values Pressure in psi | |
|---|---|
| psi | Center Panel Deflection |
| 40 lbs | 0.0275" |
| 50 lbs | 0.0445" |
| 60 lbs | 0.0635" |
| 70 lbs | 0.0740" |
| 80 lbs | 0.0820" |
| 90 lbs X | |

End Shell Buckle and Ultimate Failure = 93 lbs.

| CIRCUMFERENTIAL DOMED END SHELL VERSION #10 | |
|---|---|
| Aluminum Alloy | 5182 |
| Metal Gauge | 0.0076" |
| Outside Diameter | 2.342" |
| Unit Depth | 0.255" |
| Panel Depth | 0.076" |
| Panel Diameter | 1.640" |
| Curl Height | 0.081" |
| Countersink Radius | 0.015" |
| Chuck Wall Intersection Radius | 0.018" |
| Chuck Wall Angle | 14 degrees |
| Depth of Chuck Wall | 0.091" |
| Inner Panel Wall Radius | 0.022" |
| Inner Countersink Radius | 0.020" |
| Inner panel wall Dome Radius | 0.035" |
| Circumferential Dome Radius | 0.147" |
| Depth From Top of End Shell to Raised Outer Dome | 0.076" |

| Performance Criteria Center Panel Bulge Values Pressure in psi | |
|---|---|
| psi | Center Panel Deflection |
| 40 lbs | 0.012" |
| 50 lbs | 0.018" |
| 60 lbs | 0.028" |
| 70 lbs | 0.036" |
| 80 lbs | 0.048" |
| 90 lbs | 0.058" |
| 100 lbs | 0.063" |
| Ultimate Failure | 103 lbs |

For clarity, the following list of components and associated numbering found in the drawings are provided herein:

| No. | Components |
|---|---|
| 2 | Container end closure |
| 4 | Circular end wall |
| 6 | Chuck wall |
| 8 | Upper chuck wall |
| 10 | Lower chuck wall |
| 12 | Countersink |
| 14 | Central panel |
| 16 | Inner panel wall |
| 18 | Inner panel wall upper end |
| 20 | Inner panel wall lower end |
| 22 | Crown |
| 24 | Container body |
| 26 | Container neck |
| 28 | Seaming chuck |
| 30 | Chuck wall arch |
| 32 | Double seam |
| 34 | Seaming chuck linear wall portion |
| 36 | Seaming chuck arcuate wall portion |
| 38 | Countersink outer panel wall |
| 40 | Transition zone |
| Rc | Chuck wall arch radius of curvature |
| Rc1 | Upper chuck wall radius of curvature |
| Rc2 | Lower chuck wall radius of curvature |
| $\theta_1$ | Upper chuck wall angle |
| $\theta_2$ | Lower chuck wall angle |
| $\phi_1$ | Upper inner panel wall angle |
| $\phi_2$ | Lower inner panel wall angle |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A container end closure adapted for interconnection to a container body, comprising:

a circular end wall adapted for interconnection to a side wall of the container body;

an upper chuck wall integrally interconnected to said circular end wall and having a portion that extends downwardly at an angle θ as measured from a vertical plane, said upper chuck wall further comprising an outwardly extending arch having a radius of curvature of between about 0.015 and 0.080 inches with a center point positioned above said circular end wall;

a countersink interconnected to a lower chuck wall and having a radius of curvature of less than about 0.025 inches;

a non-linear strengthening bead positioned between said upper chuck wall and said lower chuck wall having a length no greater than about 0.005 to 0.010 inches and an orientation which is distinct from said chuck wall;

an inner panel wall interconnected to said countersink and extending upwardly at an angle ϕ of between about 0 degrees and 15 degrees as measured from a substantially vertical plane; and a central panel interconnected to an upper end of said inner panel wall and raised above a lowermost portion of said countersink.

2. The container end closure of claim 1, wherein said central panel is positioned at least about 0.150 inches below an uppermost portion of said circular end wall.

3. The container end closure of claim 1, wherein said lower chuck wall has a substantially arcuate shape.

4. The container end closure of claim 1, wherein said radius of curvature of said outwardly extending arch is greater than about 0.010 inches.

5. The container end closure of claim 1, further comprising a second strengthening bead positioned within said lower chuck wall, said second transition zone comprising a non-linear shape which is distinct from said lower chuck wall.

6. The container end closure of claim 1, wherein the interconnection of said central panel and said inner panel wall has a radius of curvature no greater than about 0.040 inches.

7. The container end closure of claim 1, wherein said upper portion of said chuck wall is oriented at an angle less than 15 degrees with respect to a vertical plane.

8. The container end closure of claim 1, wherein said upper chuck wall and said lower chuck wall have two distinct radius of curvature.

9. The container end closure of claim 1, wherein said upper chuck wall is oriented at an angle no greater than about 30 degrees.

10. The container end closure of claim 1, wherein said inner panel wall is non-linear.

11. The container end closure of claim 10, wherein said inner panel wall has at least one radius of curvature between about 0.030 inches and 0.070 inches.

12. A container end closure, comprising:

a circular end wall adapted for interconnection to a neck of a container;

a non-linear chuck wall integrally interconnected to a lower end of said circular end wall and extending downwardly, said chuck wall comprising an inwardly oriented arch having a radius of curvature of at least about 0.140 inches;

a countersink interconnected to a lower portion of said chuck wall and a lower portion of an inner panel wall and having a radius of curvature less than about 0.015 inches; and a central panel interconnected to an upper end of said inner panel wall and raised above a lowermost portion of said countersink no greater than about 0.090 inches; and at least one strengthening bead positioned between an upper end and a lower end of said chuck wall and comprising a non-linear variation in the chuck wall geometry with a horizontal length and a vertical length no greater than about 0.005 to 0.010 inches.

13. The container end closure of claim 12, wherein said interconnection between said chuck wall and said lower end of said circular end wall comprises an outwardly extending non-linear portion.

14. The container end closure of claim 13, wherein said interconnection has a radius of curvature of between about 0.015 inches and 0.20 inches.

15. The container end closure of claim 12, wherein said inner panel wall is non-linear.

16. The container end closure of claim 12, wherein said central panel has a diameter less than about 75 percent of the outer diameter of said circular end wall.

17. An end closure adapted for interconnection to a container body, comprising:

a circular end wall;

an inwardly oriented arcuate chuck wall integrally interconnected to said circular end wall and extending downwardly therefrom;

an outwardly projecting arch positioned proximate to an upper end of said chuck wall, and having a radius of curvature of between about 0.015 to 0.030 inches;

an annular countersink integrally interconnected to said lower end of said chuck wall on a first end and a central panel on a second end, said central panel having a central axis that is substantially parallel to the container body; and a strengthening bead positioned within said inwardly oriented arcuate chuck wall which has a geometry which is distinct from said inwardly oriented arcuate chuck wall.

18. The end closure of claim 17, wherein said countersink comprises an inner panel wall and an outer panel wall which are separated by a distance no greater than about 0.25 inches.

19. The end closure of claim 17, wherein said central panel is raised no more than 0.090 inches above a lowermost portion of said countersink.

* * * * *